US006019715A

United States Patent [19]

Ratzel et al.

[11] Patent Number: 6,019,715

[45] Date of Patent: Feb. 1, 2000

[54] CUSHIONING CONVERSION MACHINE AND METHOD

[75] Inventors: Richard O. Ratzel, Westlake; Joseph J. Harding, Mentor; Michael J. Lencoski, Claridon Township; James A. Simmons, Painesville; Donald J. Barnhouse, Madison, all of Ohio

[73] Assignee: Ranpak Corp., Concord Township, Ohio

[21] Appl. No.: 08/983,593

[22] PCT Filed: Jun. 26, 1996

[86] PCT No.: PCT/US96/10899

§ 371 Date: Apr. 13, 1998

§ 102(e) Date: Apr. 13, 1998

[87] PCT Pub. No.: WO97/01434

PCT Pub. Date: Jan. 16, 1997

Related U.S. Application Data

[60] Provisional application No. 60/000,496, Jun. 26, 1995.

[51] Int. Cl.[7] ..... B31B 1/00

[52] U.S. Cl. ..... 493/464; 493/475; 493/967

[58] Field of Search ..... 493/464, 967, 493/340, 475, 476, 478; 53/121; 83/175

[56] References Cited

U.S. PATENT DOCUMENTS

| | | |
|---|---|---|
| 390,442 | 10/1888 | Brigham . |
| 2,537,026 | 1/1951 | Brugger . |
| 2,786,399 | 3/1957 | Mason et al. . |
| 2,819,488 | 1/1958 | Gimble . |
| 3,337,906 | 8/1967 | Kaluza . |
| 3,400,033 | 9/1968 | Galimberti . |
| 3,485,145 | 12/1969 | Jones . |
| 3,509,798 | 5/1970 | Johnson . |
| 3,540,076 | 11/1970 | Urbutis . |
| 3,613,522 | 10/1971 | Johnson . |
| 3,717,074 | 2/1973 | Ramussen . |
| 4,026,198 | 5/1977 | Ottaviano . |
| 4,085,662 | 4/1978 | Ottaviano . |
| 4,109,040 | 8/1978 | Ottaviano . |
| 4,280,690 | 7/1981 | Hill . |
| 4,355,437 | 10/1982 | Wright . |
| 4,381,107 | 4/1983 | Armiger . |
| 4,619,635 | 10/1986 | Ottaviano . |
| 4,641,575 | 2/1987 | Cavagna . |
| 4,674,375 | 6/1987 | Golicz . |
| 4,717,613 | 1/1988 | Ottaviano . |
| 4,750,896 | 6/1988 | Komaransky et al. . |

(List continued on next page.)

FOREIGN PATENT DOCUMENTS

| | | |
|---|---|---|
| 0523382 | 6/1992 | European Pat. Off. . |
| 0679504 | 11/1995 | European Pat. Off. . |
| WO 93/19931 | 10/1993 | WIPO . |
| WO 95/13914 | 5/1995 | WIPO . |

*Primary Examiner*—John Sipos
*Assistant Examiner*—Steven Jensen
*Attorney, Agent, or Firm*—Renner, Otto, Boisselle & Sklar, P.L.L.

[57] ABSTRACT

An improved cushioning conversion machine and related methodology characterized by one or more features including, inter alia, a feeding/connecting assembly which enables an operator to easily vary a characteristic, for example, the density, of the cushioning product; a feeding/connecting assembly wherein input and/or output wheels or rollers thereof are made at least in part of an elastomeric or other friction enhancing material, which reduces the cost and complexity of the input and output rollers; a manual reversing mechanism that is useful, for example, for clearing paper jams; a modular arrangement of a forming assembly and feeding/connecting assembly in separate units that may be positioned remotely from one another, as may be desired for more efficient utilization of floor space; a turner bar which enables alternative positioning of a stock supply roll; and a volume expanding arrangement cooperative with the feeding/connecting assembly for adjusting the density of the cushioning product and changing product yield. The features of the invention may be individually or collectively used in cushioning conversion machines of various types.

37 Claims, 30 Drawing Sheets

U.S. PATENT DOCUMENTS 4,783,949 11/1988 Chopko .
4,901,993 2/1990 Hänsch .
4,968,291 11/1990 Baldacci et al. .
5,181,614 1/1993 Watts .
5,203,761 4/1993 Reichental et al. .
5,211,620 5/1993 Ratzel .
5,213,867 5/1993 Huston .
5,307,703 5/1994 Kurosawa .
5,340,638 8/1994 Sperner .
5,403,259 4/1995 Parker .
5,439,730 8/1995 Kelly .
5,466,210 11/1995 Wilcox .
5,607,383 3/1997 Armington et al. .
5,637,070 6/1997 Sasai ..... 493/321
5,656,008 8/1997 Beierlorzer .
5,782,735 7/1998 Goodrich et al. ..... 83/175
5,814,382 9/1998 Yannuzzi, Jr. ..... 493/308

CUSHIONING CONVERSION MACHINE AND METHOD

RELATED APPLICATION DATA

This application is a continuation-in-part of copending provisional application No. 60/000,496 filed Jun. 26, 1995 and a continuation of International Application No. PCT/US96/10899, filed Jun. 26, 1996.

FIELD OF THE INVENTION

The herein described invention relates generally to a cushioning conversion machine and method for converting sheet-like stock material into a cushioning product.

BACKGROUND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alterative. Paper is biodegradable, recyclable and composed of a renewable resource, making it an environmentally responsible choice for conscientious industries.

While paper in sheet form could possibly be used as a protective packaging material, it is usually preferable to convert the sheets of paper into a relatively low density pad-like cushioning dunnage product. Cushioning conversion machines in use today have included a forming device and a feeding device which coordinate to convert a continuous web of sheet-like stock material (either single-ply or multi-ply) into a three dimensional cushioning product, or pad. The forming device is used to fold, or roll, the lateral edges of the sheet-like stock material inward on itself to form a strip having a width substantially less than the width of the stock material. The feeding device advances the stock material through the forming device and it may also function as a crumpling device and a connecting (or assembling) device. The cushioning conversion machine may also include a ply-separating device for separating the plies of the web before passing through the former, and usually a severing assembly; for example, a cutting assembly for cutting the strip into sections of desired length.

European Patent Application No. 94440027.4 discloses a cushioning conversion machine wherein the feeding device comprises input and output pairs of wheels or rollers which operate at different speeds to effect, along with feeding of two plies of paper, crumpling and assembling of the paper plies to form a connected strip of dunnage. The cushioning conversion art would benefit from improvements in the machine shown in such application, and such improvements may have applicability to other cushioning conversion machines as well.

SUMMARY OF THE INVENTION

The present invention provides an improved cushioning conversion machine and related methodology characterized by one or more features including, inter alia, a feeding/connecting assembly which enables an operator to easily vary a characteristic, for example, the density, of the cushioning product; a feeding/connecting assembly wherein input and/or output wheels or rollers thereof are made at least in part of an elastomeric or other friction enhancing material, which reduces the cost and complexity of the input and output rollers; a manual reversing mechanism that is useful, for example, for clearing paper jams; a modular arrangement of a forming assembly and feeding/connecting assembly in separate units that may be positioned remotely from one another, as may be desired for more efficient utilization of floor space; a layering device which provides for doubling of the layers of sheet material in the converted cushioning product; a turner bar which enables alternative positioning a stock supply roll; and a volume expanding arrangement cooperative with the feeding/connecting assembly for reducing the density of the cushioning product and increasing product yield. The features of the invention may be individually or collectively used in cushioning conversion machines of various types. These and other aspects of the invention are hereinafter summarized and more fully described below.

According to one aspect of the invention, a cushioning conversion machine, for making a cushioning product by converting an essentially two-dimensional web of sheet-like stock material of at least one ply into a three-dimensional cushioning product, generally comprises a housing through which the stock material passes along a path; and a feeding/connecting assembly which advances the stock material from a source thereof along said path, crumples the stock material, and connects the crumpled stock material to produce a strip of cushioning. The feeding/connecting assembly includes upstream and downstream components disposed along the path of the stock material through the housing, at least the upstream component being driven to advance the stock material toward the downstream component at a rate faster than the sheet-like stock material can pass from the downstream component to effect crumpling of the stock material therebetween to form a strip of cushioning. Additionally, at least one of the upstream and downstream components includes opposed members between which the stock material is passed and pinched by the opposed members with a pinch pressure; and a tension control mechanism is provided for adjusting the amount of pinch pressure applied by the opposed members to the stock material. In one embodiment of the invention, the tension control mechanism includes an accessible control member outside the housing for enabling easy operator adjustment of the pinch pressure, whereby a characteristic of the strip of cushioning can be varied on demand. In another embodiment, the upstream and downstream components each include opposed members between which the stock material is passed and pinched by the opposed members with a pinch pressure; and a tension control mechanism is provided for adjusting the amount of pinch pressure applied to the stock material by the opposed members of the downstream component independently of the pinch pressure applied to the stock material by the opposed members of the upstream component, whereby a characteristic of the strip of cushioning can be varied.

According to another aspect of the invention, a cushioning conversion machine again generally comprises a housing through which the stock material passes along a path; and a feeding/connecting assembly which advances the stock material from a source thereof along the path, crumples the stock material, and connects the crumpled stock material to produce a strip of cushioning. The feeding/connecting assembly includes upstream and downstream feeding components disposed along the path of the stock material through the housing, the upstream feeding component being driven to advance the stock material toward the downstream component at a rate faster than the sheet-like stock material can pass from the downstream component to effect crumpling of the stock material therebetween to form the strip of cushioning. An adjustable speed control mechanism is provided for varying the ratio of the feeding speeds of the upstream and downstream feeding components, whereby a characteristic of the strip of cushioning can be varied. In a preferred embodiment, the adjustable speed control mechanism can include, for example, a variable speed drive device (such as a variable pitch pulley systems for one of the upstream and downstream components, a quick change gear set, or a variable speed control for at least one of respective drive motors for the upstream and downstream components. Preferably, a control member is provided outside the housing for enabling easy operator adjustment of the speed ratio, whereby a characteristic of the strip of cushioning can be varied on demand.

According to a further aspect of the invention, a cushioning conversion machine again generally comprises a housing through which the stock material passes along a path; and a feeding/connecting assembly which advances the stock material from a source thereof along the path, crumples the stock material, and connects the crumpled stock material to produce a strip of cushioning. The feeding/connecting assembly includes upstream and downstream components disposed along the path of the stock material through the housing, at least the upstream component being driven to advance the stock material toward the downstream component at a rate faster than the sheet-like stock material can pass from the downstream component to effect crumpling of the stock material therebetween to form a strip of cushioning. Also provided is a stretching component downstream of the downstream component that is operative to advance the strip of cushioning at a rate faster than the rate at which the stock material passes from the downstream component to effect longitudinal stretching of the strip of cushioning.

According to yet another aspect of the invention, a cushioning conversion machine again generally comprises a housing through which the stock material passes along a path; and a feeding/connecting assembly which advances the stock material from a source thereof along the path, crumples the stock material, and connects the crumpled stock material to produce a strip of cushioning. The feeding/connecting assembly includes upstream and downstream components disposed along the path of the stock material through the housing, at least the upstream component being driven to advance the stock material toward the downstream component at a rate faster than the sheet-like stock material can pass from the downstream component to effect crumpling of the stock material therebetween to form a strip of cushioning. At least one of the upstream and downstream components includes opposed members between which the stock material is passed and pinched by the opposed members with a pinch pressure; and at least one of the opposed members is at least partially made of an elastomeric material at a surface thereof engageable with the stock material.

According to a still further aspect of the invention, a cushioning conversion machine generally comprises a housing through which the stock material passes along a path; and a feeding/connecting assembly which advances the stock material from a source thereof along the path, crumples the stock material, and connects the crumpled stock material to produce a strip of cushioning. The feeding/connecting assembly includes at least one rotatable member rotatable in a first direction for engaging and advancing the stock material along the path, a feed motor for driving the one rotatable member in the first direction, and a crank coupled to the rotatable member for enabling rotation of the one rotatable member in a second direction opposite the first direction. In a preferred embodiment the crank is coupled to the rotatable member by a one-way clutch.

According to yet still another aspect of the invention, a cushioning conversion machine comprises first and second units having separate housings whereby the first and second units can be located at spaced apart locations. The first unit includes in the housing thereof a former for folding the sheet-like stock material to form flat folded stock material having a plurality of layers each joined at a longitudinally extending fold to at least one other layer. The second unit includes in the housing thereof an expanding device operative, as the flat folded stock material passes therethrough, to separate adjacent layers of the flat folded stock material from one another to form an expanded strip of stock material, and a feeding/connecting assembly which advances the stock material through the expanding device, crumples the expanded stock material passing from the expanding device, and connects the crumpled strip to produce a strip of cushioning.

In a preferred embodiment, the units are used in combination with a table to form a packaging system, the table including a table top having a packaging surface. The first and second units may be both located beneath said packaging surface, and one may be supported atop the other. In alternative arrangement, the first unit may be located beneath the table top and the second unit may supported on the table top.

According to another aspect of the invention, a cushioning conversion machine generally comprises a supply assembly for supplying the sheet-like stock material; and a conversion assembly which converts the sheet-like stock material received from the supply assembly into a three-dimensional strip of cushioning. The stock supply assembly includes a support for a supply of the stock material from which the stock material can be dispensed, and a layering device which effects folding of the stock material along a fold line parallel to the longitudinal axis of the stock material, thereby in effect doubling the number of layers of the stock material that are converted into a cushioning product.

According to a further aspect of the invention, a cushioning conversion machine comprises a forming assembly through which the sheet-like stock material is advanced to form the stock material into a three-dimensional shape and a feeding/connecting assembly that advances and crumples the formed strip, and connects the crumpled formed strip to produce a strip of cushioning. The forming assembly includes a forming member and a converging chute cooperative with the forming member to cause inward rolling of the edges of the stock material to form lateral pillow-like portions of a formed strip, and the feeding/connecting assembly includes upstream and downstream components disposed along the path of the stock material through the machine, at least the upstream component being driven to advance the stock material toward the downstream component at a rate faster than the sheet-like stock material can pass from the downstream component to effect crumpling of the stock material therebetween to form a strip of cushioning.

According to yet another aspect of the invention, a cushioning conversion machine comprises a feeding/connecting assembly which advances the stock material from a source thereof along a path through the machine, crumples the stock material, and connects the crumpled stock material to produce a strip of cushioning. The feeding/connecting assembly includes upstream and downstream feeding components disposed along the path of the stock material through the housing, the upstream feeding component being driven continuously to advance continuously the stock material toward the downstream feeding component during a cushioning formation operation, and the downstream feeding component being driven intermittently to advance periodically the stock material. Accordingly, when the downstream feeding component is not driven the stock material will be caused to crumple longitudinally between the upstream and downstream feeding components, and when driven the longitudinally crumpled stock material will be advanced by the downstream feeding component toward an exit end of the machine.

According to a still further aspect of the invention, a method for making a cushioning product, by converting an essentially two-dimensional web of sheet-like stock material of at least one ply into a three-dimensional cushioning product, generally includes the steps of supplying the stock material, and using an upstream component of a feeding/connecting assembly to advance the stock material toward a downstream component of the feeding/connecting assembly at a rate faster than the stock material can pass from the downstream component to effect crumpling of the stock material therebetween to form the strip of cushioning, the upstream and downstream components including opposed members between which the stock material is passed and pinched by the opposed members with a pinch pressure. In one embodiment, the method includes the step of adjusting the amount of pinch pressure applied by the opposed members of the downstream component independently of the pinch pressure applied to the stock material by the opposed members of the upstream component to the stock material, whereby a characteristic of the strip of cushioning can be varied. In another embodiment, the method includes the step of varying the ratio of the feeding speeds of the upstream and downstream feeding components, whereby a characteristic of the strip of cushioning can be varied.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
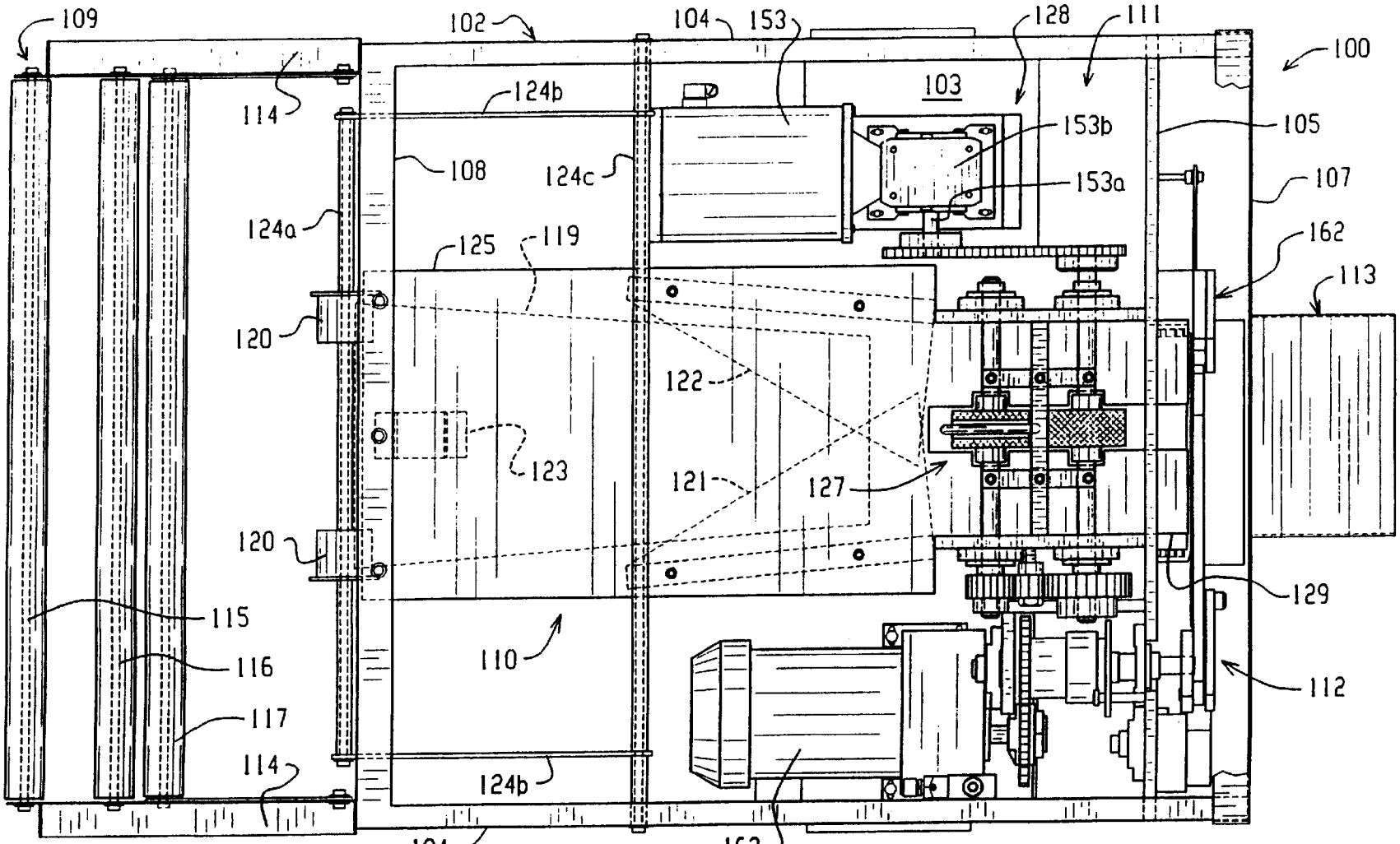
FIG. 1 is a top plan view of a cushioning conversion machine according to the present invention, the machine including a housing, stock-supply assembly, a forming assembly, a feeding/connecting assembly, a severing assembly, and a post-severing assembly.
Figure 2:
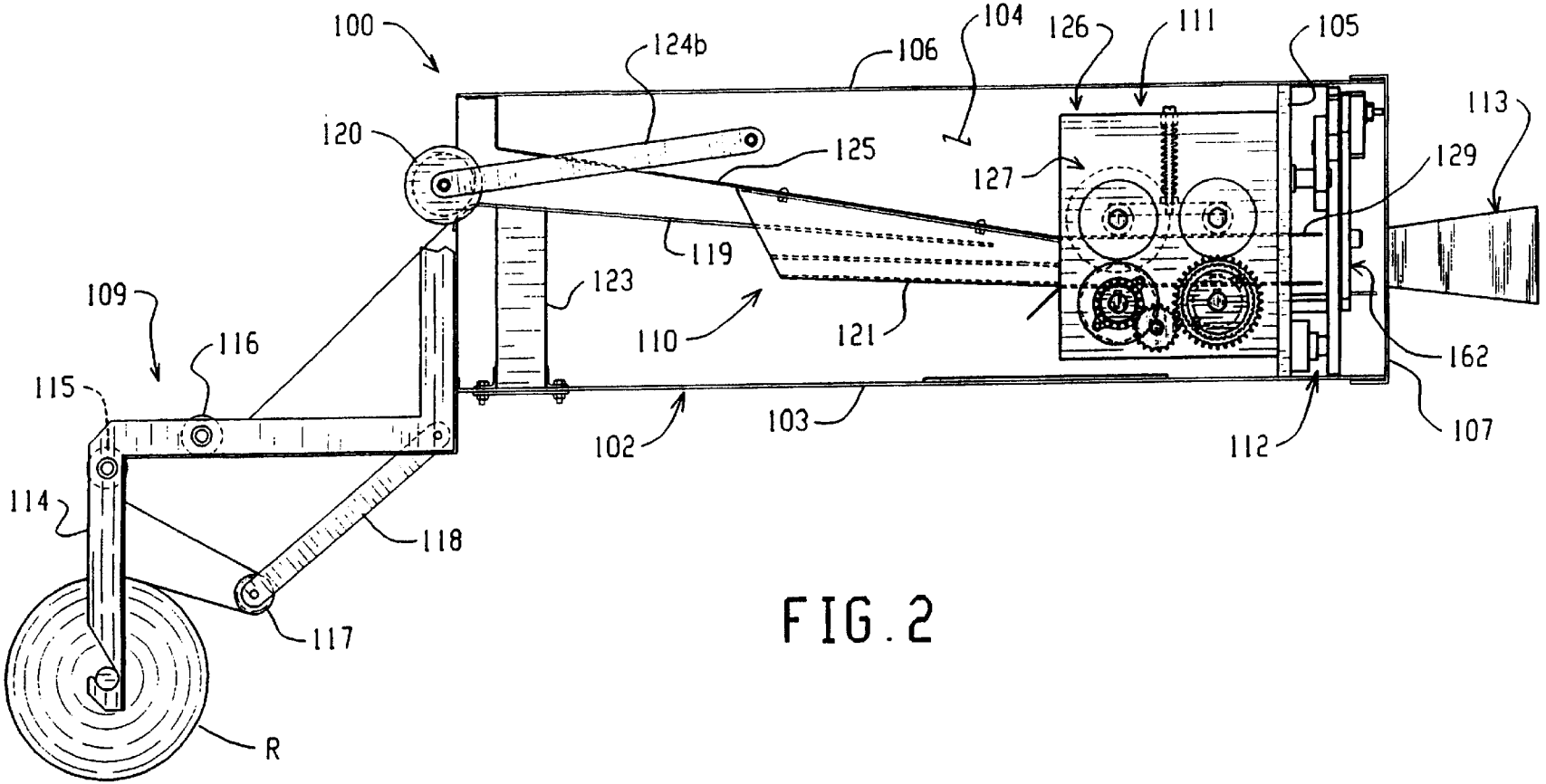
FIG. 2 is a schematic side elevational view of the cushioning conversion machine 100.

In FIGS. 1 and 2, a cushioning conversion machine 100 according to the present invention is shown. The machine 100 converts an essentially two-dimensional web of sheet-like stock material (the thickness thereof being negligible compared to the width and length thereof—thus the phrase "essentially two-dimensional) into a three-dimensional cushioning product of a desired length. The preferred stock material consists of plural plies or layers of biodegradable and recyclable sheet-like stock material such as 30 to 50 pound Kraft paper rolled onto a hollow cylindrical tube to form a roll R of the stock material. More preferably, the stock material consists of two plies of paper which are intermittently glued together with small drops of glue up the center of the paper plies, the glue drops being spaced approximately one foot apart. The preferred cushioning product has lateral accordion-like or pillow-like portions and is connected, or assembled, along a relatively thin central band separating the pillow-like portions.

The cushioning conversion machine 100 includes a housing 102 having a base plate or wall 103, side plates or walls 104, a downstream end plate or wall 105, a top cover 106, and a downstream cover, or wall 107. The base, side, and end walls 103–105 collectively form the machine's frame structure. The top cover 106, together with the base, side and end walls 103–105, form an enclosure for the interior assemblies of the machine 100. (It should be noted that the terms "upstream" and "downstream" in the context of the present application correspond to the direction of flow of the stock material through the machine 100.)

The walls 103–107 of the housing 102 are each generally planar and rectangular in shape. The upstream edges of the base wall 103 and sides walls 104 are turned in to form, along with a top bar 108, a rectangular border defining a centrally located, and relatively large, rectangular stock inlet opening. The rectangular border may be viewed as an upstream end plate or wall extending perpendicularly from the upstream edge of the base wall 103. The end plate 105 extends perpendicularly from a location near, but inward from, the downstream end of the base wall 103 and defines a dunnage outlet opening. The downstream cover wall 107 is attached to the downstream edges of the base wall 103, with the side walls 104 and a downstream portion of the top cover 106 forming a box-like enclosure for certain components of the machine 100. Preferably, the cover wall 107 may be selectively opened to provide access to these components. The downstream portion of the top cover preferably is fixedly secured in place while an upstream portion of the top cover may be in the form of a hinged door which may be opened to gain access to the interior of the housing and particularly the below mentioned forming assembly to facilitate loading of the stock material in a well known manner.

The cushioning conversion machine 100 further includes a stock supply assembly 109, a forming assembly 110, a feeding/connecting assembly 111, a severing assembly 112, and a post-severing assembly 113. During the preferred conversion process, the stock supply assembly 109 supplies stock material to the forming assembly 110. The forming assembly 110 causes inward folding of lateral edge portions of the sheet-like stock material into an overlapping relationship. The feeding/connecting assembly 111 advances the stock material through the machine 100 and also crumples the folded over stock material to form a dunnage strip. As the dunnage strip travels downstream from the feeding/connecting assembly 111, the severing/aligning assembly 112 severs or cuts the dunnage strip into sections, or pads, of a desired length. The cut pads then travel through the post-severing assembly 113.

The stock supply assembly 109 includes support brackets 114 which are laterally spaced apart and mounted to the upstream end of the machine's housing 102. The stock supply assembly 109 also includes first and second guide rollers 115 and 116 which are rotatably mounted between the support brackets 114, and a dancer roller 117 which is pivotally suspended from the support brackets 114 via swing arms 118. As paper is unwound from the stock or supply roll R, it travels around the dancer roller 117 so that the pull of the paper upward on the dancer roller 117, combined with the pull of gravity downward on the dancer roller and swing arms 118, helps maintain a uniform tension on the paper. The paper then travels over and under the two guide rollers 115 and 116 to guide the paper into the forming assembly 110.

The forming assembly 110 consists of a central plate 119, a pair of fold-down rollers 120, with folding elements 121 and 122 forming a chute-like passage, or chute, for lateral edge portions of the stock material. The central plate 119 is mounted on a pedestal 123 attached to the base wall 103 and slopes slightly downwardly, and tapers inwardly, going from the upstream end to the downstream end of the central plate. The rollers 120 are mounted on a shaft 124*a* extending between the ends of a pair of swing arms 124*b* that are pivotally connected at their opposite ends to a support bar 124*c* extending between the side walls 104. The folding elements 121 and 122 are mounted, in a cantilever-like fashion, from a mounting plate 125.

As the paper enters the forming assembly 110, the central portion of the paper (preferably about ⅓ of the paper width) will be positioned on the central plate 119 and its remaining lateral edge portions (preferably each about ⅓ the paper width) will be urged, or folded, downward by the rollers 120. As the paper contacts the folding elements 121 and 122, the folding elements will fold the lateral edge portions of the paper inward one over the other, whereby they will overlap in a folded arrangement. This overlapped paper, or strip, advances to the feeding/connecting assembly 111.

The feeding/connecting assembly 111 includes a support structure 126, a wheel (or roller) network 127, a drive system 128, and a guide chute 129. The feeding/connecting components 126–129 feed the stock material, for example by pulling it from the stock supply assembly 109 and through the forming assembly 110. The feed/connecting assembly 111 longitudinally crumples the strip of stock material and then connects, or assembles, overlapped portions of stock material together to lock in a desired three-dimensional geometry of the resultant pad.

With additional reference to FIGS. 3 and 5A–5C, the support structure 126 includes a pair of vertical side plates 130, and a horizontal cross bar 131. The downstream edges of the side plates 130 are coupled to the machine's housing 102, and more particularly to the end wall 105. The cross bar 131 extends between and is secured to the side plates 130.

As best shown in FIGS. 3 and 5A–5C, the wheel network 127 includes a feed (or input) wheel 132, a support wheel 133 for the feed wheel 132, a compression (or output) wheel 134, a support wheel 135 for the compression wheel 134, and shafts 137–140 for each of the wheels 132–135, respectively. The lower wheels 132 and 134 are secured to the shafts 137 and 139, respectively, and the upper wheels 133 and 135 are rotatably mounted on their shafts 138 and 140, respectively.

During operation of the feeding/connecting assembly 111, the lower shafts 137 and 139 are positively driven by the drive system 128 to rotate the lower wheels 132 and 134 which will in turn rotate the upper, or "idler", wheels 133 and 135. The lower shafts 137 and 139 extend between, and are rotatably journalled in the support side plates 130. (See FIGS. 3 and 5A–5C.)

The upper shaft 140 extends between the side plates 130 and has its opposite ends positioned within a vertical guide slot 130*a* in the corresponding side plate 130. (See FIGS. 3 and 5A–5B.) The upper shaft 138 has opposite ends thereof terminating short of the side plates. A pair of laterally spaced apart shaft connectors 142 are connected between the upper shafts 138 and 140, and each shaft connector is attached, at about the middle thereof, to the lower end of a respective suspension pin or member 143. Each pin extends vertically though a respective guide opening in the cross bar 131 and carries thereon a compression spring 144 interposed between the cross bar and shaft connector. In this manner, the upper or "idler" wheels 133 and 135 will be resiliently biased towards the corresponding lower wheels 132 and 134, while being able to vertically "float" relative thereto during operation of the machine 100.

As seen in FIGS. 4A–4D, the wheels 132 and 133 are both generally cylindrical in shape. The feed wheel 132 includes a middle portion 145 separating opposite axial end portions 146. The middle portion 145 is in the form of an annular groove which, for example, may have an approximately rectangular (as shown) or semi-circular cross section. The cylindrical periphery of the opposite axial end portions 146 is interrupted by flat faces 147. The flat faces 147 on one end portion 146 are staggered relative to the flat faces on the other end portion 146. In other words, the flat faces 147 on one axial end portion 146 are aligned with the "non-flat", or arcuate, knurled areas 148 on the other axial end portion 146. The support wheel 133 for the feed wheel 132 also includes a middle portion 149 separating opposite axial end portions 150. The middle portion 149 is in the form of a radially outwardly protruding annular rib which is preferably rounded at its radial outer side, while the end portions 150 have knurled radial outer surfaces.

The radial outer surfaces of one or both of the wheels 132 and 133, or portions thereof, may be manufactured from an elastomeric material, such as rubber (neoprene or urethane) thereby reducing the cost and complexity of the wheels while still providing a high level of friction-enhancement for relatively slip free engagement with the stock material.

As seen in FIGS. 4E–4H, the wheels 134 and 135 are also both generally cylindrical in shape. The compression wheel 134 includes a middle portion 151 separating opposite axial end portions 152. The middle portion 151 is radially relieved and has a smooth radial surface. The end portions 152 are ribbed to form rectangular, circumferentially spaced apart teeth. The support wheel 135 for the compression wheel 134 includes a continuous, knurled outer diameter surface. The radial outer surfaces of one or both of the wheels 134 and 135, or portions thereof, may again be manufactured from an elastomeric material such as rubber (neoprene or urethane) thereby reducing the cost and complexity of the wheels while still providing a high level of friction-enhancement for relatively slip free engagement with the stock material.

Figure 3:
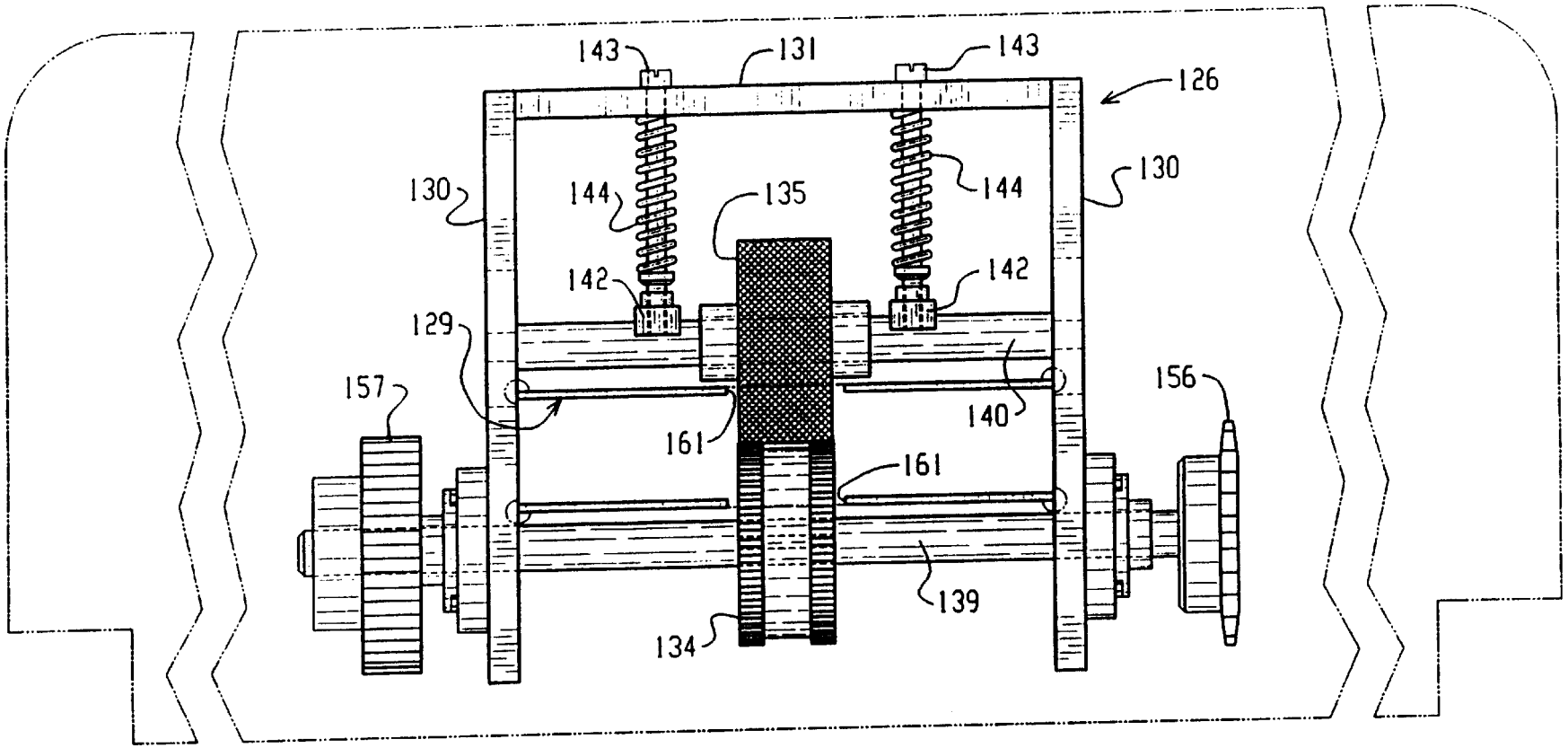
FIG. 3 is a sectional view of the feeding/connecting assembly of the machine 100 and relevant portions of the machine's housing.
Figure 3A:
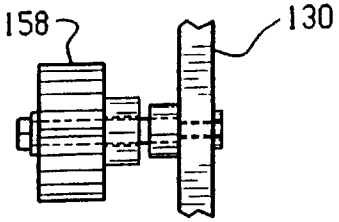
FIG. 3A is a fragmentary view of a gear of the feeding/connecting assembly and a relevant portion of the machine's housing.
Figure 4H:
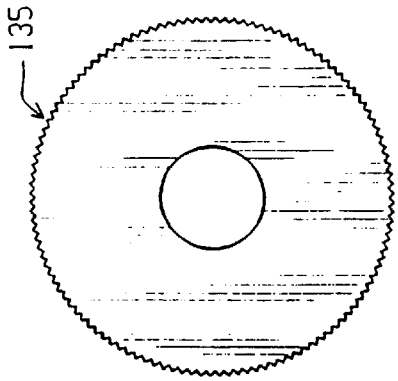
FIGS. 4G and 4H are edge and side views, respectively, of a component of the feeding/connecting assembly, namely a support wheel for a compression wheel.
Figure 4F:
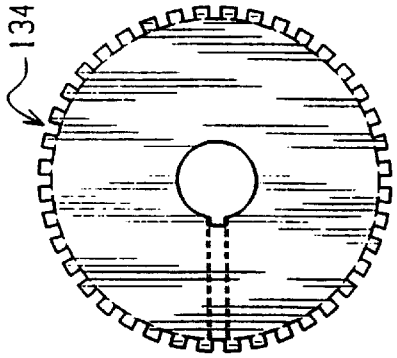
FIGS. 4E and 4F are edge and side views, respectively, of a component of feeding/connecting assembly, namely a compression wheel.
Figure 4G:
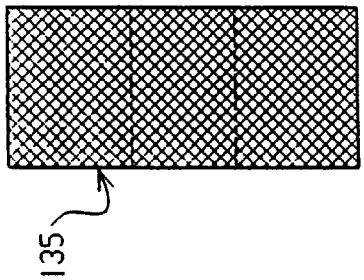
Figure 4E:
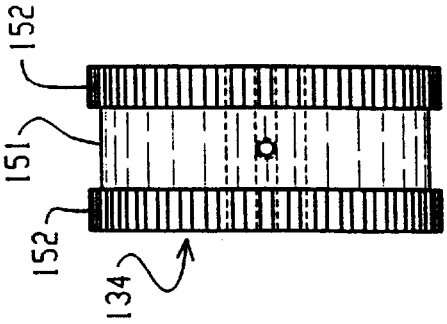
Figure 4D:
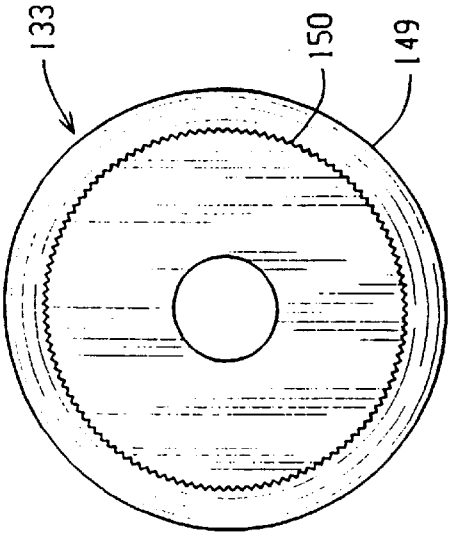
FIGS. 4C and 4D are edge and side views, respectively, of a component of the feeding/connecting assembly, namely a support wheel for the feed wheel.
Figure 4B:
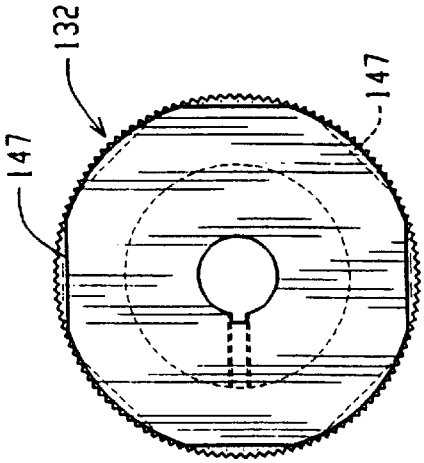
FIGS. 4A and 4B are edge and side views, respectively, of a component of the feeding/connecting assembly, namely a feed wheel.
Figure 4C:
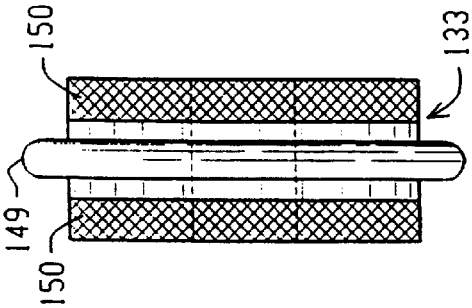
Figure 4A:
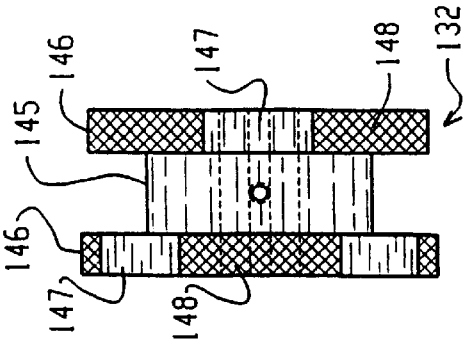
Figure 5A:
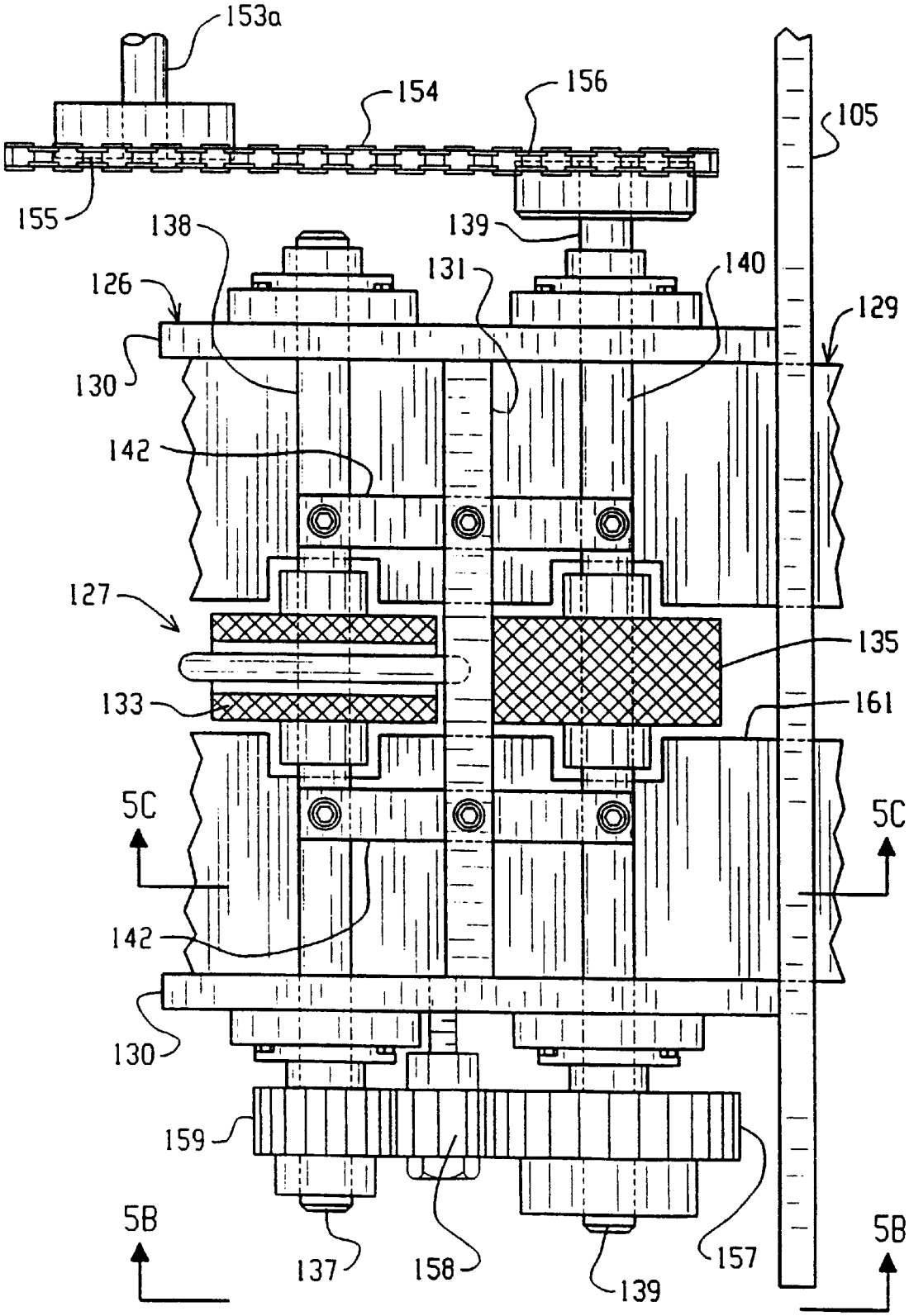
FIG. 5A is an isolated plan view of the feeding/connecting assembly, along with relevant parts of the machine's frame or housing.

As seen in FIG. 1, the drive system 128 for the feeding/connecting assembly 111 includes an electric motor 153, and motion-transmitting elements 154–159 (FIGS. 3, 3A and 5A). The motor 153 is mounted to the base plate 103 on one side of the forming assembly 110. The motion-transmitting elements transfer the rotational power of the motor 153 to the wheel network 127, or more particularly the lower shafts 137 and 139.

As seen in FIGS. 3, 3A and 5A, the motion-transmitting elements include a drive chain 154 and sprockets 155 and 156. The sprocket 155 is secured to an output shaft 153*a* of a speed reducing gear box 153*b* driven by the motor 153 (See FIG. 1), and the sprocket 156 is secured to the compression wheel shaft 139. The drive chain 154 is trained around the sprockets 155 and 156 to rotate the compression wheel shaft 139.

The motion transmitting elements 157–159 are gears forming a gear train between the compression wheel shaft 139 and the feed wheel shaft 137. The gear 157 is secured to the end of the compression wheel shaft 139 opposite the sprocket 156, the gear 158 is rotatably mounted to support side plate 130, and the gear 159 is secured to an adjacent end of the feed wheel shaft 137. In this manner, the feed wheel shaft 137 and the compression wheel shaft 139 will rotate in the same direction. However, the gears are selected so that the shaft 137 (and thus the feed wheel 132) is rotating at a faster feed rate than the shaft 139 (and thus the compression wheel 134). In the illustrated embodiment, the set speed ratio is on the order of about 1.7:1 to about 2.0:1.

Figure 5C:
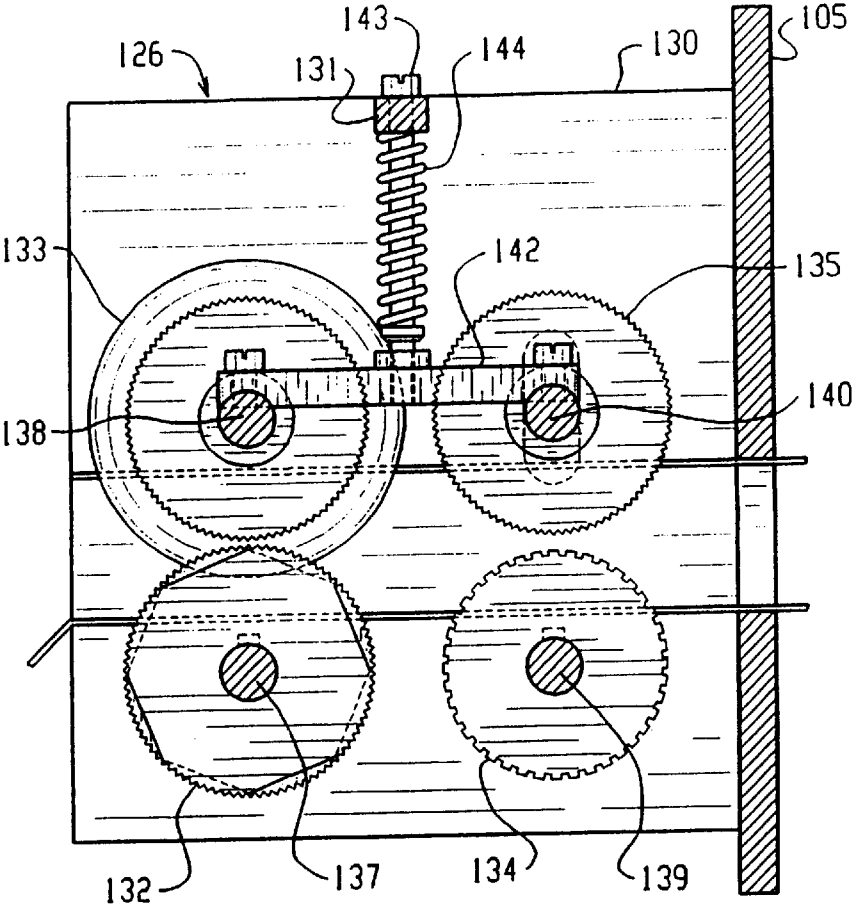
FIG. 5C is a sectional view of the feeding/connecting assembly, taken along line 5C—5C of FIG. 5A.
Figure 5B:
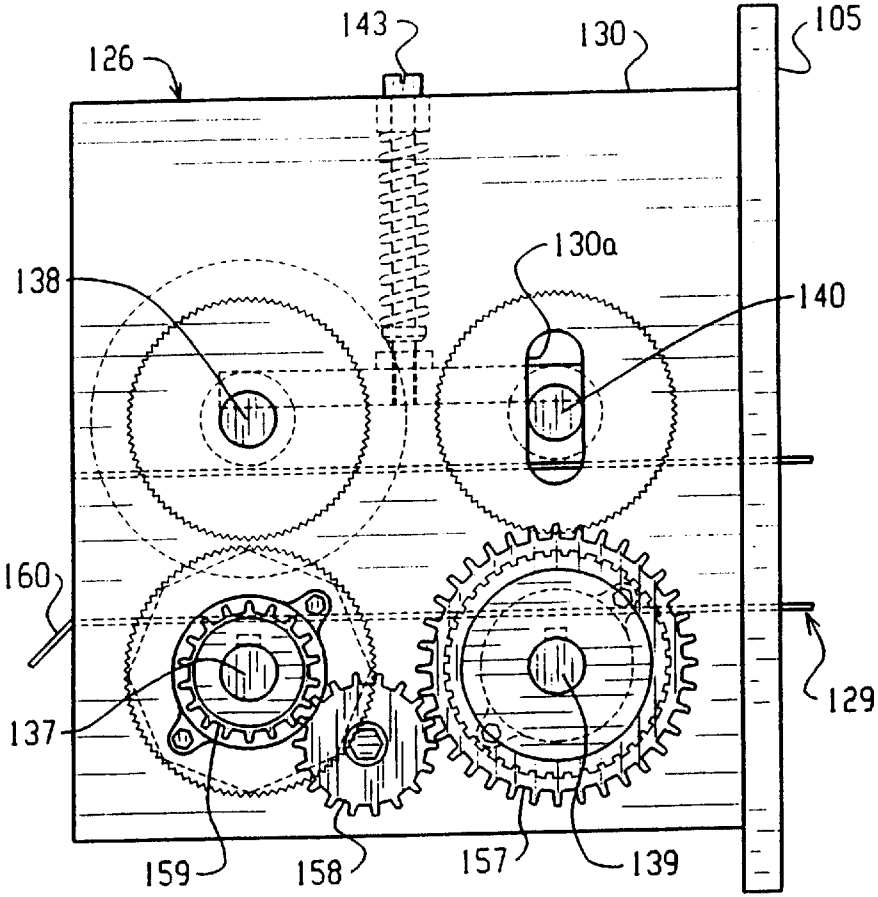
FIG. 5B is a side view of the feeding/connecting assembly, as seen from the line 5B—5B in FIG. 5A.

As seen in FIGS. 1 and 2, the guide chute 129 extends from the exit end of the forming assembly 110 to the outlet opening in the housing end wall 105. In FIG. 3, the guide chute 129 can be seen to be substantially rectangular in cross-section. The upstream bottom and/or side edges of the chute preferably flare outwardly to form a funnel or converging mouth inlet 160 (FIG. 5B). The top and bottom walls of the guide chute 1129 each include an opening 161 through which the wheels 132–135 extend into the interior of the guide chute (FIGS. 5A–5C). It will be appreciated that the cross-sectional dimensions (i.e., width and height) of the guide chute 129 approximate the cross-sectional dimensions of the cushioning product.

The strip formed in the forming assembly 110 is urged into the guide chute 129 through its funnel inlet 160 whereat it is engaged and fed forwardly (or downstream) by the feed wheel 132 and its support wheel 133. The staggered arrangement of the flat faces 147 on the end portions 146 of the wheel 133 will cause the strip to be fed alternately from each side of its longitudinal axis, instead of just being pulled only axially. That is, the strip will be fed alternately from each side of its longitudinal axis, instead of being pulled only axially. This advance by successive pulls from one side and then the other side back and forth makes it possible to have at the center a surplus of paper with respect to its flat configuration, this surplus being generated by the rib 159 fitting in the mating groove in the wheel 132. The strip is then engaged by the compression wheel 134 and its support wheel 135. Because the wheels 134 and 135 are rotating at a slower speed than the wheels 132 and 133, the strip is longitudinally crumpled between the upstream and downstream pairs of wheels with the latter compressing folds in the strip. (For further information regarding an assembly similar to the feeding/connecting assembly 111, reference may be had to European Patent Application No. 94440027.4, filed Apr. 22, 1994 and published on Nov.2, 1995 under Publication No. 0 679 504 A1, which is hereby incorporated herein by reference.) The strip then exits the guide chute 129 and passes through the dunnage outlet opening in the end wall 105.

As the strip exits the feeding/connecting assembly 111 and passes through the dunnage outlet opening in the end wall 105, the severing assembly 112 severs its leading portion into a desired length. The illustrated severing assembly 112 includes cutting components 162 preferably powered by an electric motor 163 (FIG. 1). The cutting components 162 are mounted on the downstream surface of the end wall 105 are contained within the enclosure closed by the downstream cover 107. The severing motor 163 is mounted on the base wall 103 on the side of the forming assembly opposite the feed motor 153. (See FIGS. 1 and 2.) A suitable severing assembly is disclosed in U.S. patent application Ser. No. 08/188,305, which is hereby incorporated by reference. The cut sections of dunnage then travel through the post-severing assembly 113.

As seen in FIGS. 1 and 2, the post-severing assembly 113 is mounted to the downstream cover 107. The inlet and outlet of the assembly 113 are aligned with the dunnage outlet opening in the end wall 105. The post-severing assembly 113 is rectangular in cross-sectional shape and flares outwardly in the downstream direction. As the cut section of the dunnage strip, or pad, emerges from the outlet of the assembly 113, the pad is ready for use as a cushioning product.

Figure 17:
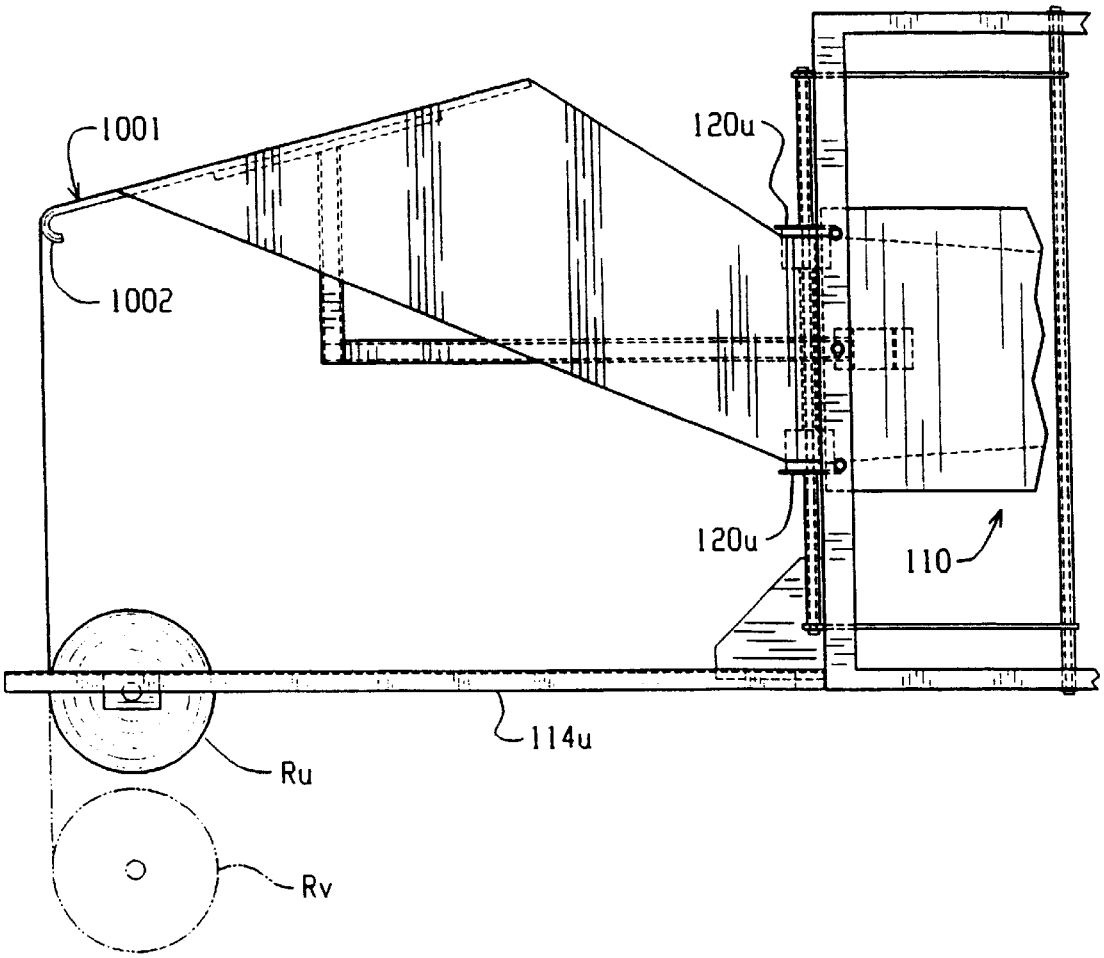
FIG. 17 is a partial plan view of a modified version of the stock supply assembly of FIGS. 1–2.
Figure 18:
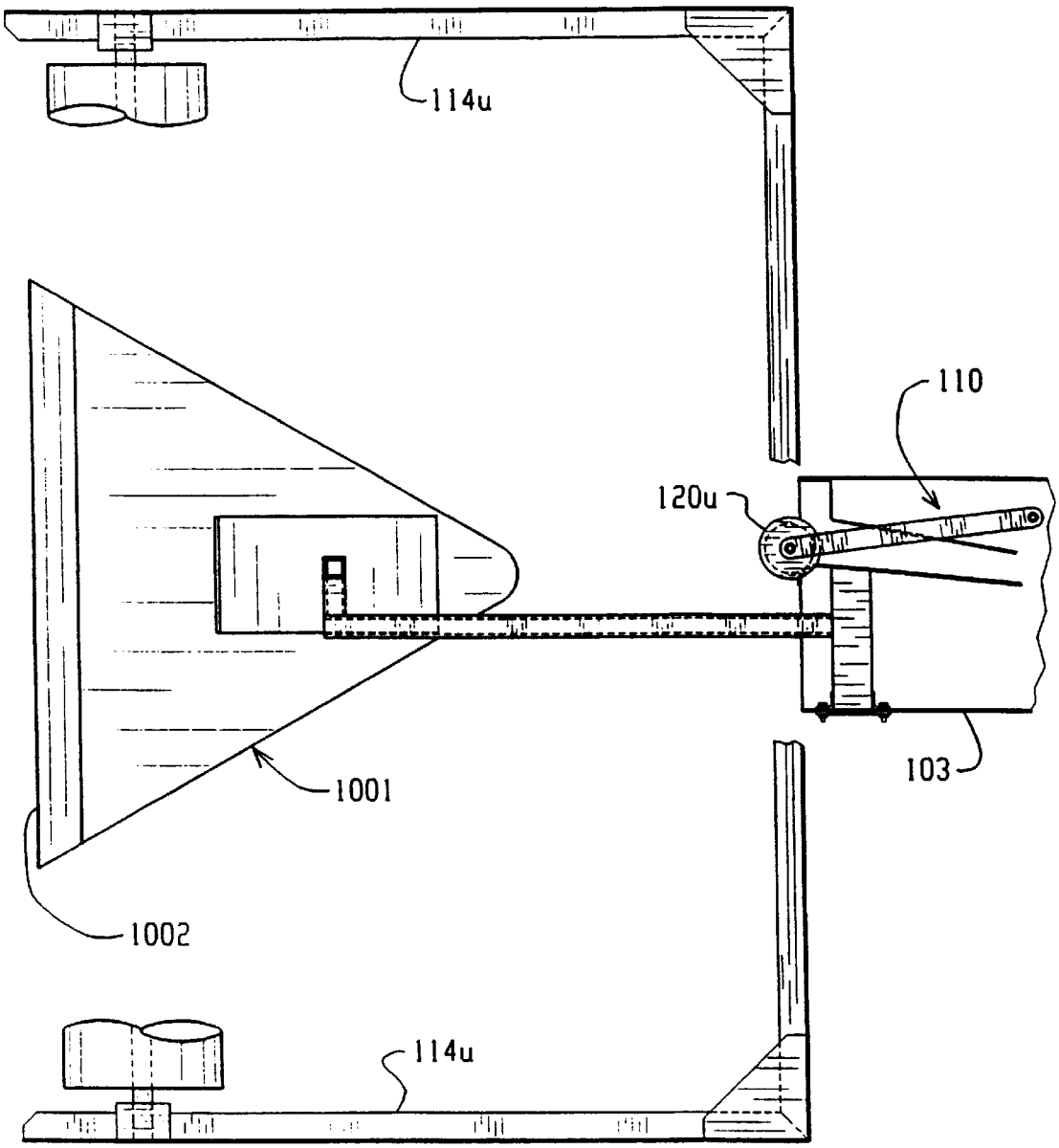
FIG. 18 is side elevation view of the modified version of the stock supply assembly of FIG. 17.

Referring now to FIGS. 17 and 18, a modified form $\mathbf{109}_u$ of stock supply assembly is shown. The stock supply assembly 109, operates to layer the stock material prior to its entry into the forming assembly 110. While the stock supply assembly $\mathbf{109}_u$ could be used with multi-ply stock material to double the number of layers of material, it is preferably used with single-ply stock material, in that it eliminates the need for rewinding single-ply stock material into multi-ply rolls.

The stock supply assembly $\mathbf{109}_u$ includes a pair of support brackets $\mathbf{114}_u$ which are vertically spaced (as opposed to laterally spaced like the brackets 114) and support the stock roll $R_u$, in a vertical orientation (the stock roll will usually be twice as wide as the normal width because the stock material is folded over on itself to provide a two layer web). The stock supply assembly $\mathbf{109}_u$ further includes a layering plate 1001 which is vertically positioned upstream of the fold-down rollers $\mathbf{120}_u$, via a bracket suspending it from a pedestal on the base wall 103. The layering plate 1001 is generally triangular except that it includes a rounded entry edge 1002. As the stock material is unwound from the roll $R_u$ in a vertical plane and pulled over the layering plate 1001 into the forming assembly 110, it is folded in half into a web having two layers. This web is positioned in a horizontal plane ready for receipt by the forming assembly 110. If desired, the stock roll may be supported in a horizontal orientation with its axis oriented perpendicular to the entry path into the forming assembly 110 and an angled turner bar employed between the stock roll and the layering plate to guide the sheet material from a horizontal plane as it is payed off the stock roll to a vertical plane for passage to the layering plate 1001. It will also be appreciated that a horizontal disposition of the stock roll may also be obtained by rotating the entire machine embodiment of FIGS. 17 and 18 by 90 degrees about its longitudinal axis. In addition, additional layers may be provided by supplying stock material from one or more additional rollers, as schematically illustrated by the stock roll $R_v$. Two, three or more stock rolls may be used with the other embodiments herein described if desired.

According to another aspect of the invention, a modified version of the feeding/connecting assembly 111 may include interchangeable quick change gear sets are provided to provide respective different feed rate ratios between the input and output wheel of the wheel network. These gear sets would be similar to the gears 157–159 (FIG. 5B), except they would be of different sizes or tooth number to produce a corresponding change in feed rate ratio and thus the pad characteristics as may be desired. By employing appropriate marking on the gear sets corresponding to desired packaging applications, changes in the speed ratio could be accomplished with minimal training on the part of a machine operator by substituting the proper gear set for a given application. As explained herein, the speed ratio between the feed wheel 132 (FIG. 5C) and compression wheel 134 affects the characteristics (such as density, compactness, cushioning ability, etc.) of the pad produced during the conversion process. While the set speed ratio provided by the gear train 157–159 may be appropriate in many situations, it may be desirable to selectively change this speed ratio to alter pad characteristics Specifically, if the speed differential is increased, a stiffer, more dense pad will be produced for use in, for example, the packaging of heavier objects. On the other hand, if the speed differential is reduced, a less dense pad will be produced (possibly resulting in greater yield from a given amount of stock material) for use in, for example, the packaging of lighter objects.

In another modified form of the feeding/connecting assembly, two separate feed motors could be used, one for the feed wheel shaft 137 (FIGS. 5A and 5C) and one for the compression wheel shaft 139. Either or both of the motors could have a variable speed option to allow selective adjustment of the speed ratio. It is noted that if these motors are directly coupled to the shafts 137 and 139, the need for the motion-transmitting elements 154–159 (FIG. 5A) would be eliminated. In any event, this modification would eliminate the need for the gear train 157–159 (FIG. 5A).

Figure 7:
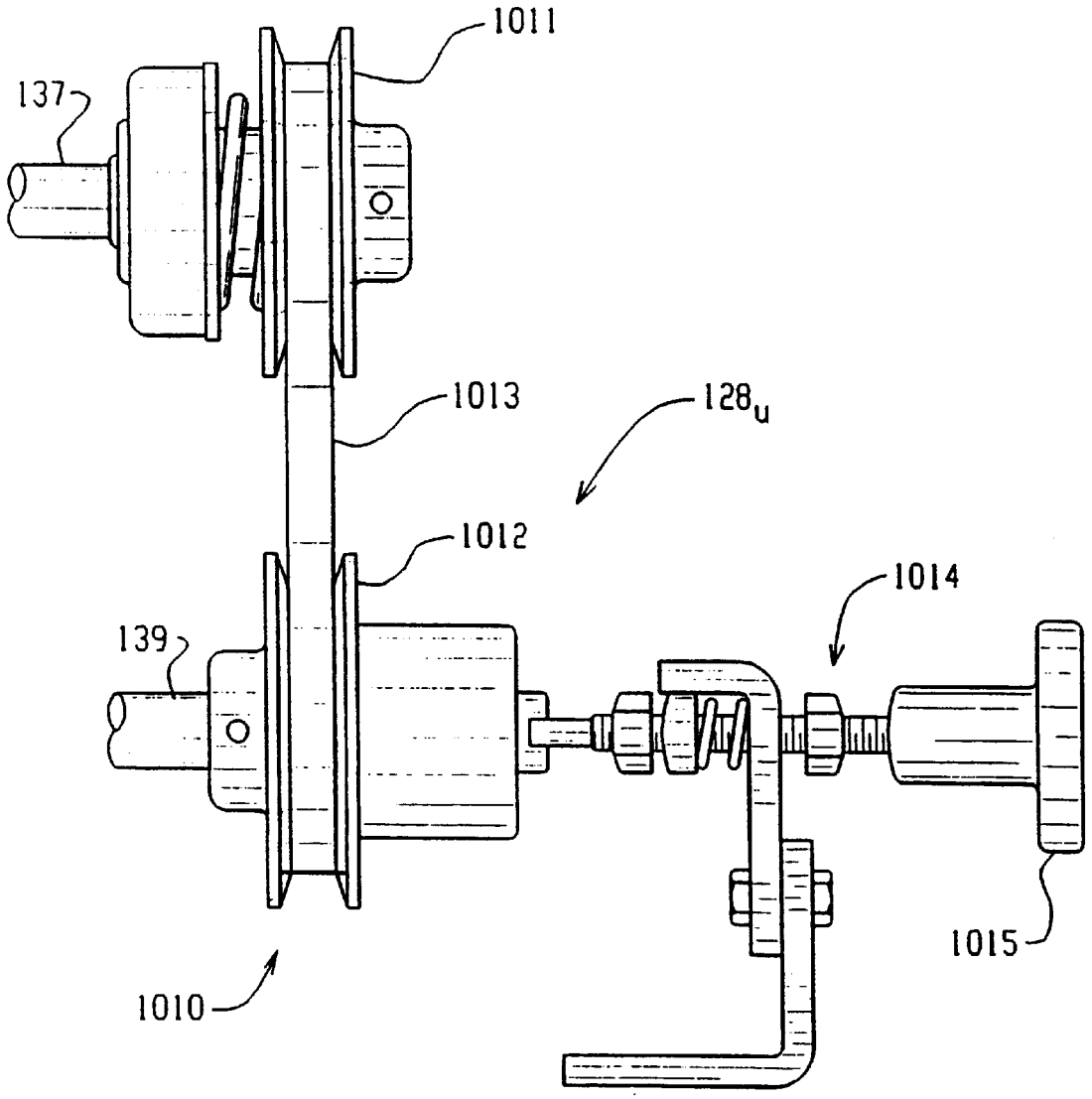
FIG. 7 is a side view of portions of a modified version of the feeding/connecting assembly of FIGS. 1–2.

In another modified version of the feeding/connecting assembly, shown partially in FIG. 7, the gear train 157–159 (FIG. 5A) of the drive system $\mathbf{128}_u$ is replaced with a variable pitch pulley assembly 1010. In the drive system $\mathbf{128}_u$, the variable pitch pulley assembly 1010 controls the speed ratio between the feed wheel shaft 137 and the compression wheel shaft 139. The illustrated pulley 1010 includes a SL-sheave 1011 coupled to the feed wheel shaft 137, a MC-sheave 1012 coupled to the compression wheel shaft 139, and a V-belt 1013 trained therebetween. An adjustment device 1014 allows manual control (via a control knob 1015 preferably positioned outside the machine's housing for easy access) of the position of the V-belt 1013 on the sheaves 1011 and 1012 to thereby vary the speed ratio between shafts 137 and 139, in well known manner.

Figure 8:
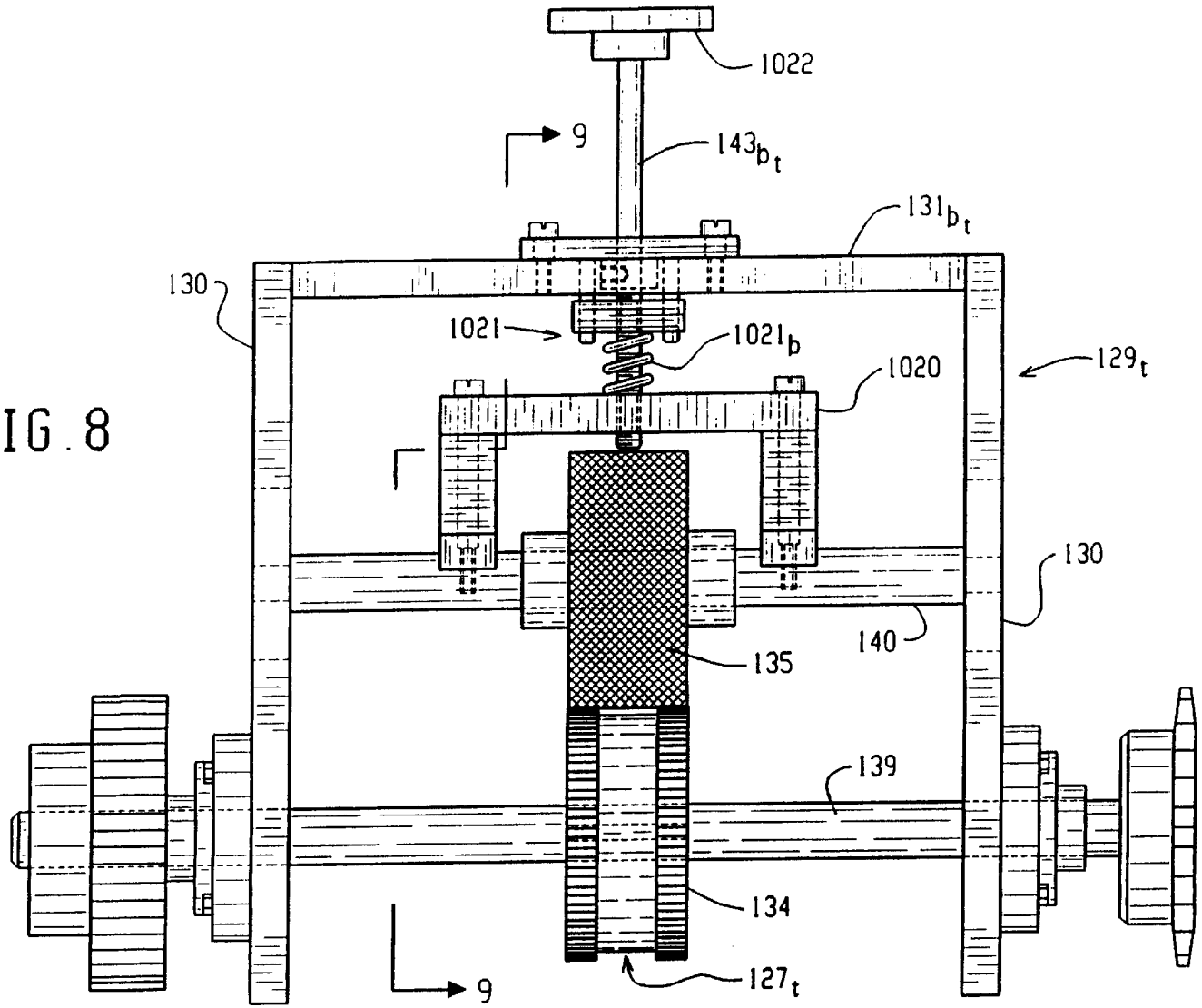
FIG. 8 is a side view of portions of a modified version of the feeding/connecting assembly of FIGS. 1–2.
Figure 9:
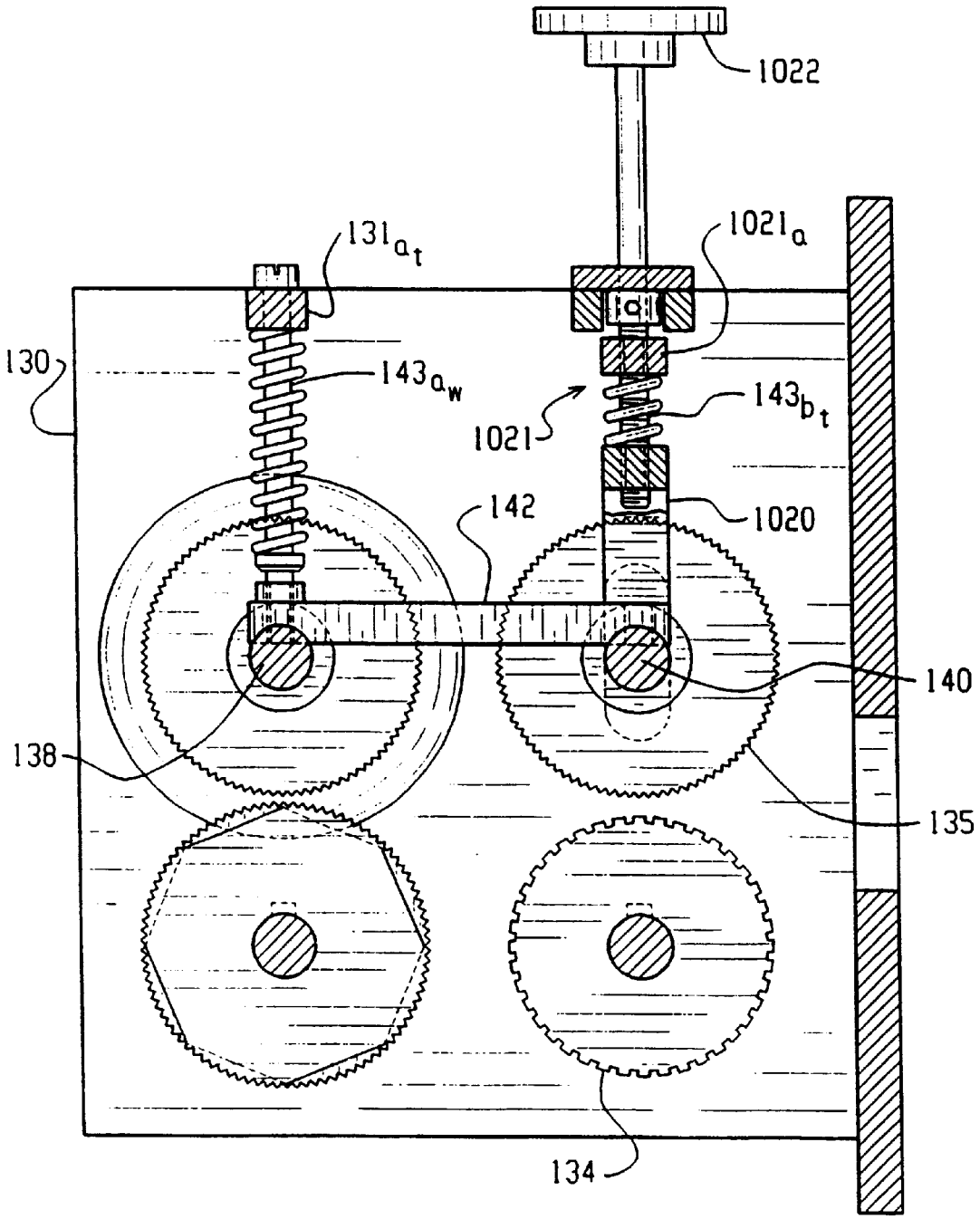
FIG. 9 is a sectional view taken along line 9—9 in FIG. 8.

Another modified form of the feeding/connecting assembly is shown in FIGS. 8 and 9 which is designed to provide for a convenient, and even dynamic, selective change in the biasing force between the compression wheel 134 and its support wheel 135. The support structure $\mathbf{129}_t$ of the wheel network $\mathbf{127}_t$ includes a pair of horizontal cross bars $\mathbf{131}a_t$ and $\mathbf{131}b_t$ which extend between, and are secured to, the side plates 130. The cross bar $\mathbf{131}a_t$ is vertically aligned with the shaft 138 and the cross bar $\mathbf{131}b_t$ is vertically aligned with the shaft 140.

A first pair of pins $\mathbf{143}a_t$ (similar to the suspension pins 143) couple the shaft connectors 142 to the first support cross bar $\mathbf{131}a_t$. The pins $\mathbf{143}a_t$ extend from the ends of the shaft-connectors 142 adjacent the shaft 138. Another pin

143$b_t$ is coupled to the shaft connectors 142 via a yoke 1020 connected to the ends of the shaft connectors 142 adjacent the shaft 140. The pin 143$b_t$ is attached to the cross bar 131$b_t$ via an adjustment device 1021. The adjustment device includes an adjustable stop 1021*a* into which the pin 143$b_t$ is threaded such that rotation of the pin will move the adjustable stop towards and away from the shaft 140. A spring 1021$b_t$ is interposed between the adjustable stop 1021*a* and the cross member 131$b_t$ of the yoke 1020. Accordingly, rotation of the pin will increase or decrease the biasing force acting on the yoke and in turn on the shaft 140 and wheel 135, it being noted that the pin is free to rotate relative to the yoke.

As is preferred, the end of the pin projecting above the cross bar has secured thereto a knob 1022. As will be appreciated, the knob provides for easy manual adjustment of the biasing force acting on the shaft 140. The knob preferably is located external to the machine's housing, or at least at a conveniently accessible location within the machine's housing. If the knob 1022 is tightened, the biasing force between the compression wheel 134 and its support wheel 135 will be increased, thereby creating a more dense pad. If the knob 1022 is loosened, the biasing force will be decreased, thereby creating a less dense pad. Dynamic changes could be made while the machine is operating to change pad characteristics "on the fly." If desired, the knob may be replaced by other drive mechanisms, such as an electric motor that may be remotely controlled for adjustment of the biasing force.

Figure 10:
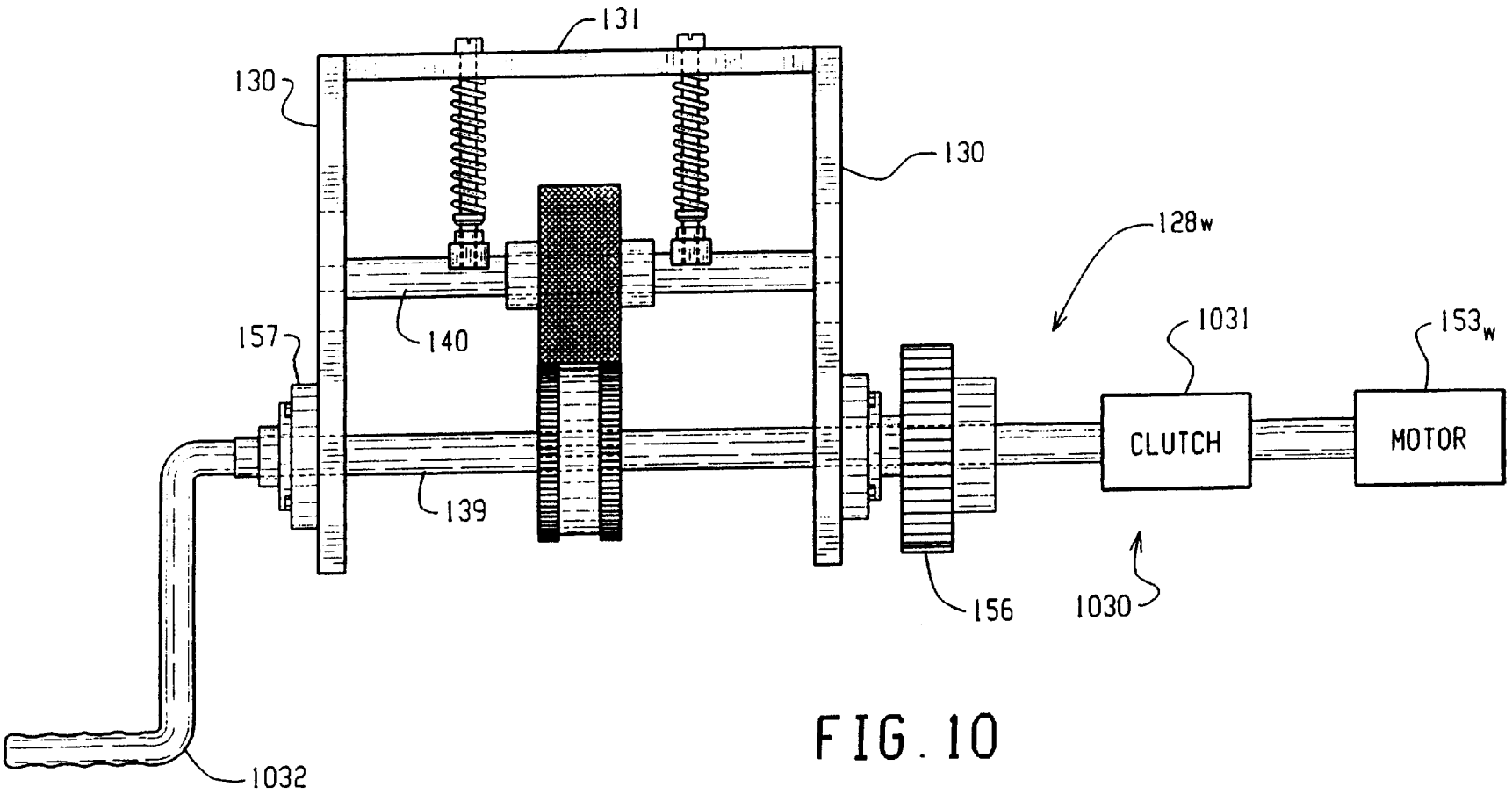
FIG. 10 is a schematic view of portions of a modified version of the feeding/connecting assembly of FIGS. 1–2.
Figure 11A:
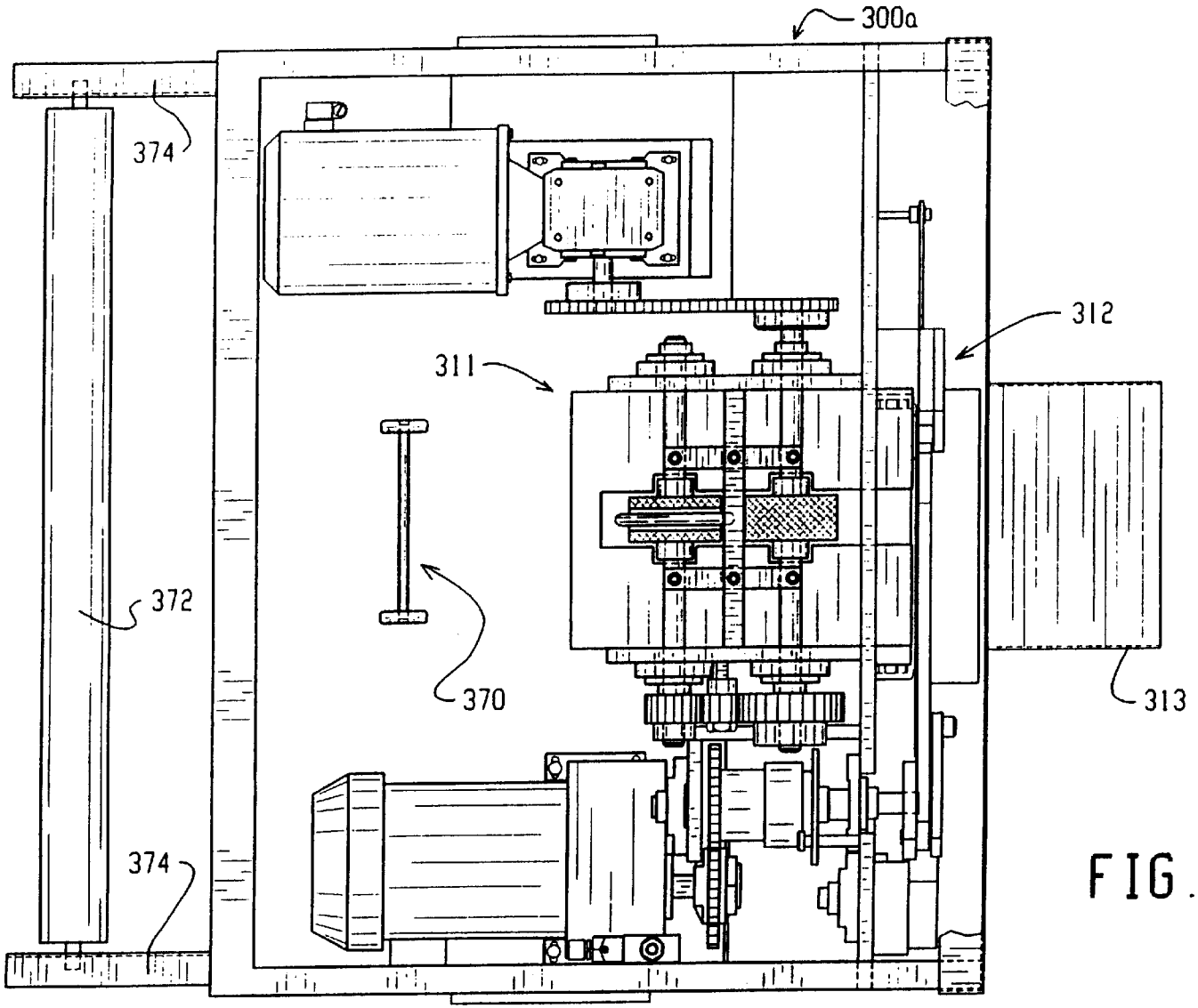
FIGS. 11A and 12 are schematic plan view of first and second modular units of another cushioning conversion machine according to the present invention.
Figure 11C:
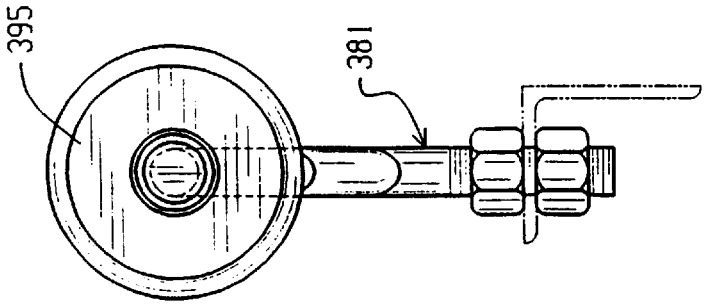
FIG. 11C is a side view of the expanding device of FIG. 11B, without the stock material.
Figure 11B:
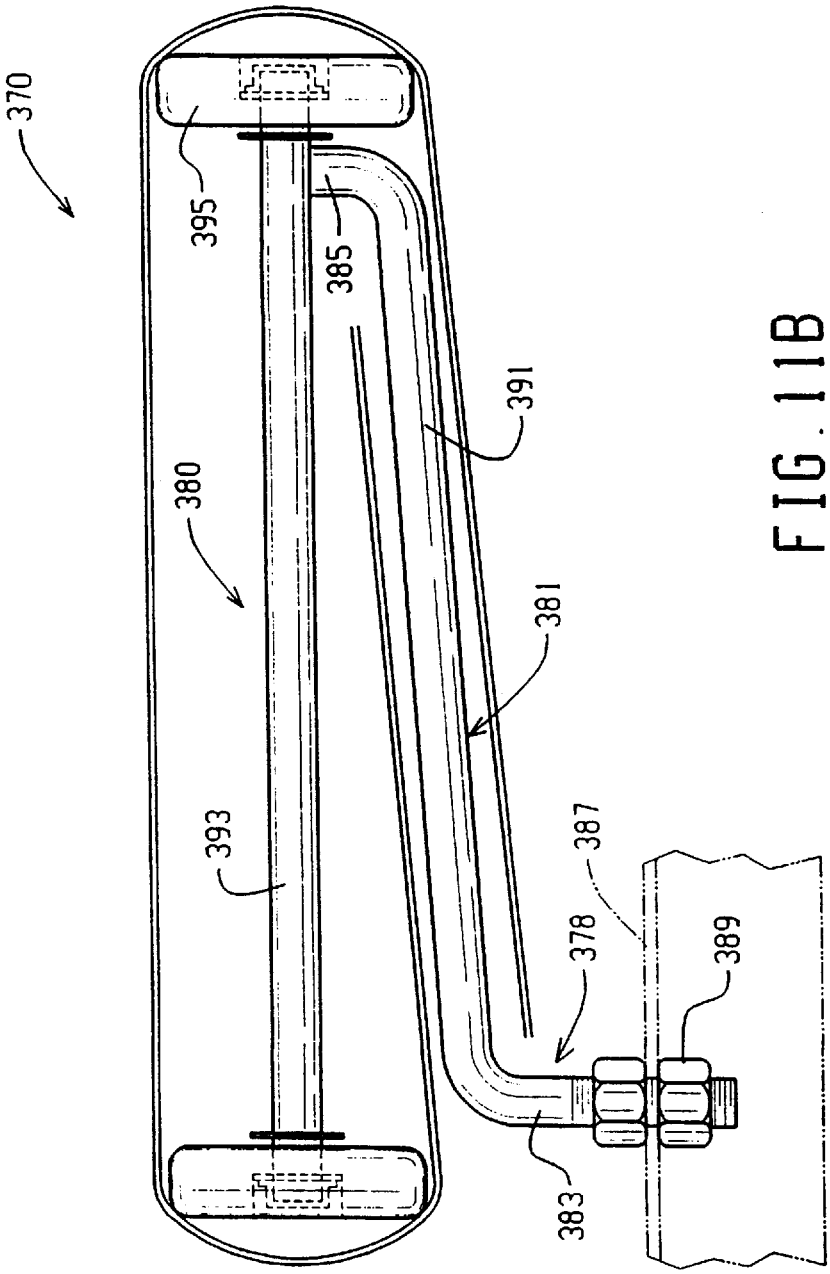
FIG. 11B is an end view of device of the first modular unit, namely an expanding device, the device being shown with flat-folded stock material expanded thereby.
Figure 12:
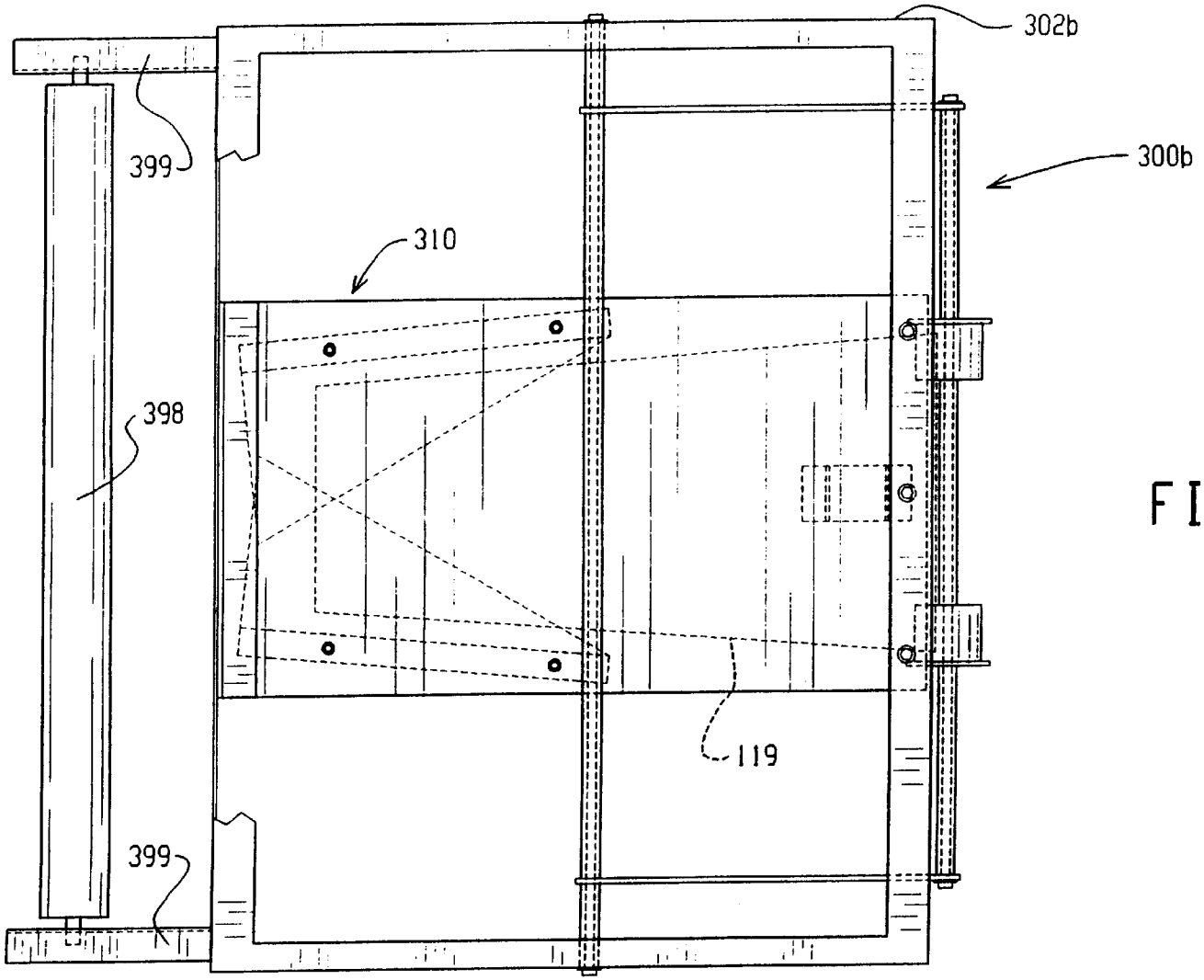

The drive system 128$_w$ of another modified form of the feeding/connecting assembly is shown in FIG. 10. The drive system 128$_w$ includes a reversing device 1030 which allows the reverse movement of the feeding/connecting assembly to, for example, clear paper jams in the machine. The device 1030 includes a clutch 1031 and a hand crank 1032. The clutch 1031 allows selective disengagement of the shaft of the motor 153$_w$ from the compression wheel shaft 139. The hand crank 1032 is coupled to the compression wheel shaft 139 so that, upon disengagement of the motor drive shaft, the shaft 139 may be manually turned in the reverse direction. The hand crank 1032 can be permanently fixed to the machine as shown, or can be "folded away," or even removed during normal operation. Alternatively, the motor could be reversed to effect reverse movement of the feeding/connecting assembly.

Figure 20:
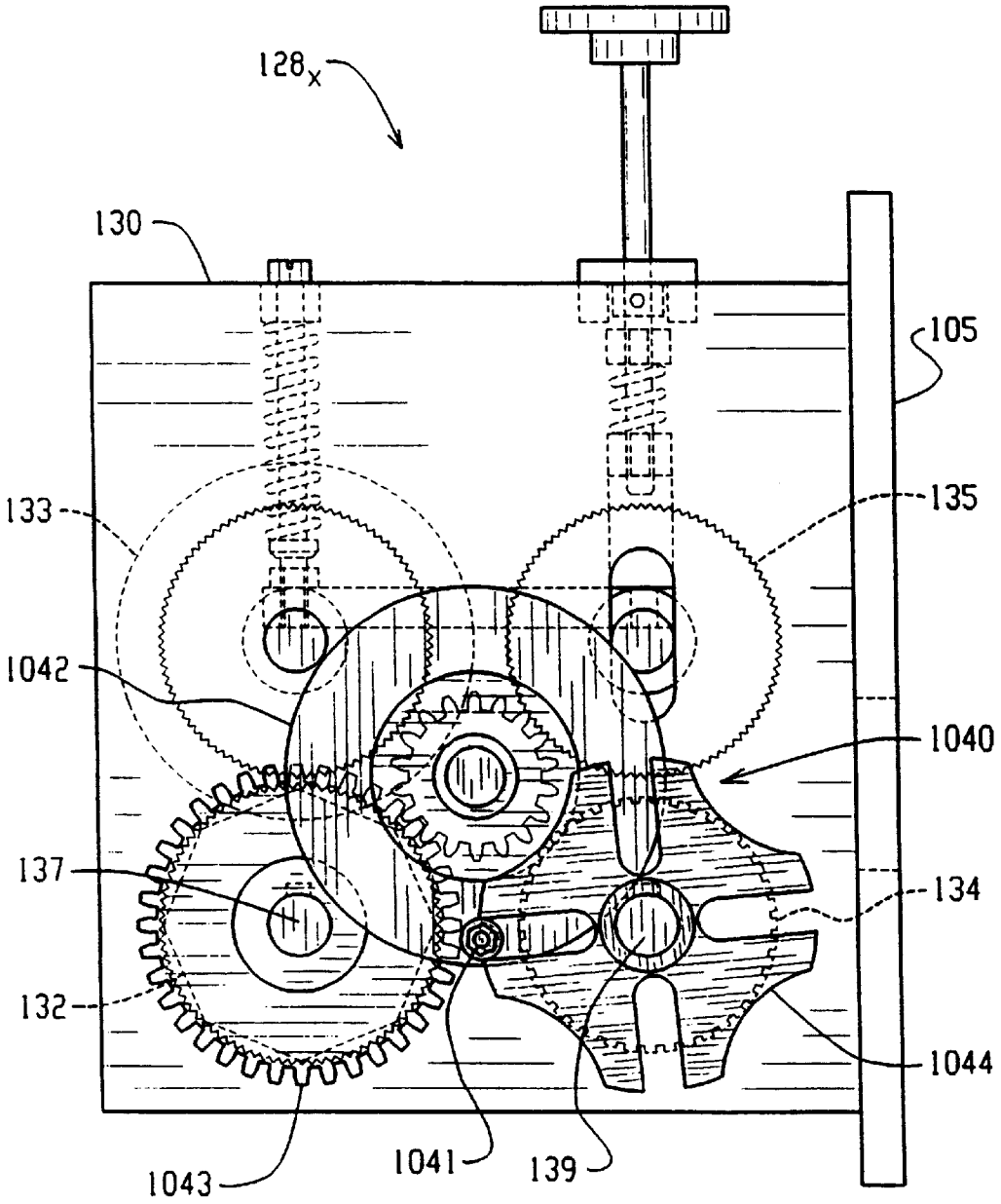
FIG. 20 is a side elevation view of a modified version of the feeding/connecting assembly of FIGS. 1 and 2.
Figure 21:
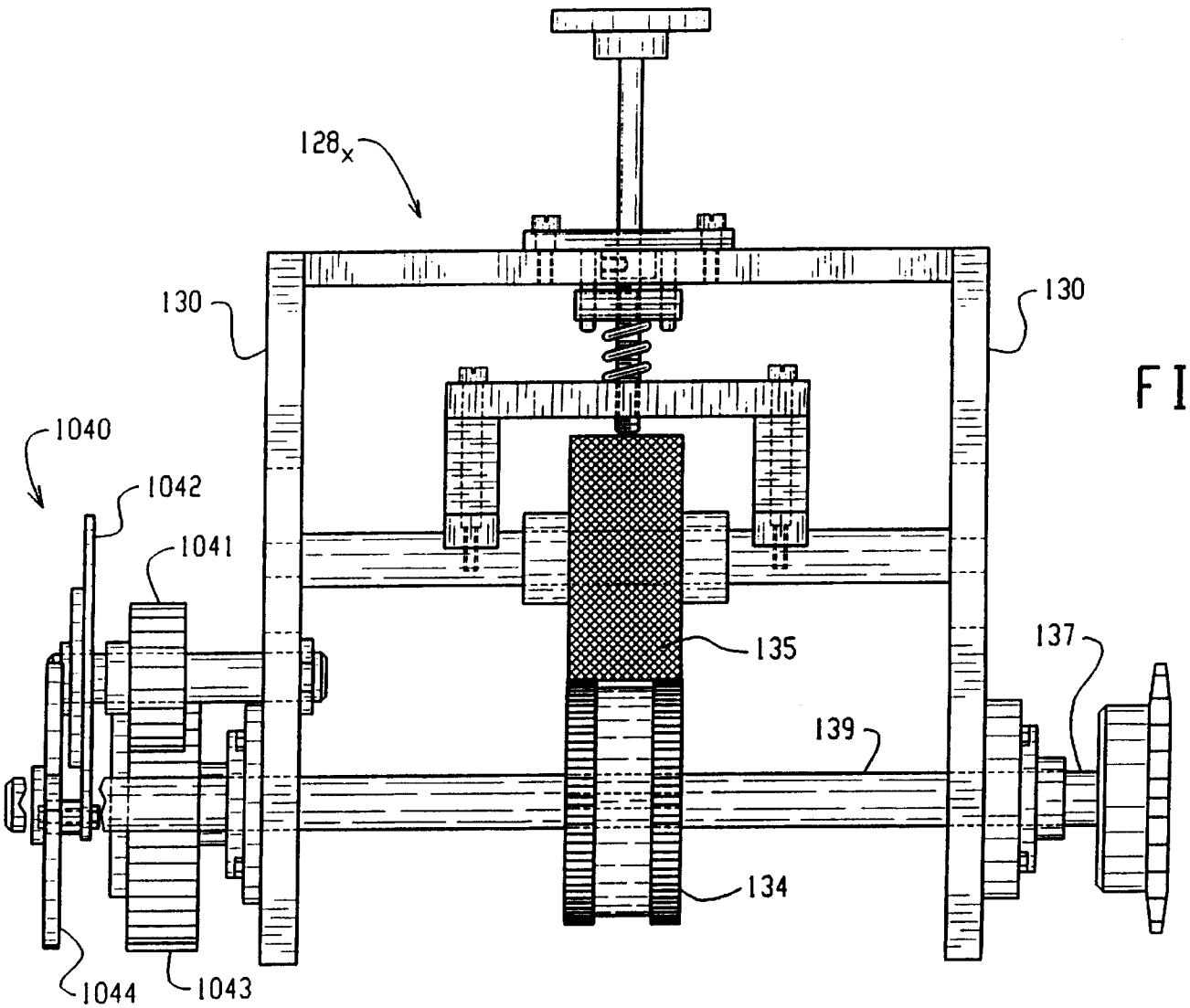
FIG. 21 is an end elevation view of the feeding/connecting assembly of FIG. 20.

Another modified form of the feeding/connecting assembly is shown in FIGS. 20 and 21, this assembly incorporating a modified drive system 128$_x$. In the modified drive system 128$_x$, the feed wheel shaft 137 (and thus the feed wheel 132 and its support wheel 133) is directly driven by the motor 153 at a constant speed. However, the compression wheel shaft 139 (and thus the compression wheel 134 and its support wheel 135) are driven intermittently, rather than continuously, by an indexing device 1040 which replaces the gear train 157–159. When the indexed wheels 134 and 135 are not rotating, the stock material is crumpled as the rotating wheels 132 and 133 continue to advance stock material downstream. When the indexed wheels 134 and 135 are rotating, the stock material will be emitted from the feeding/connecting assembly.

The indexing device 1040 is a conventional "Geneva" gear mechanism and, in the illustrated device, the compression wheel 134 rotates a quarter of a revolution for every half revolution of the feed wheel 132. The device 1040 includes a driver disk 1042 mounted to the support wall 130, a cam pin 1041 mounted to the driver disk 1042, a gear 1043 coupled to the end of the feed shaft 137, and a four-slotted disk 1044 coupled to the end of the compression wheel shaft 138. The driver disk is indexed with the compression shaft 139 so that upon every half revolution of the feed wheel shaft 137, the driver disk 1042 will also make one revolution. As the driver disk 1042 makes one revolution, it will cause the four-slotted disk 1044 to rotate a quarter of a revolution via the cam pin 1041.

Figure 19A:
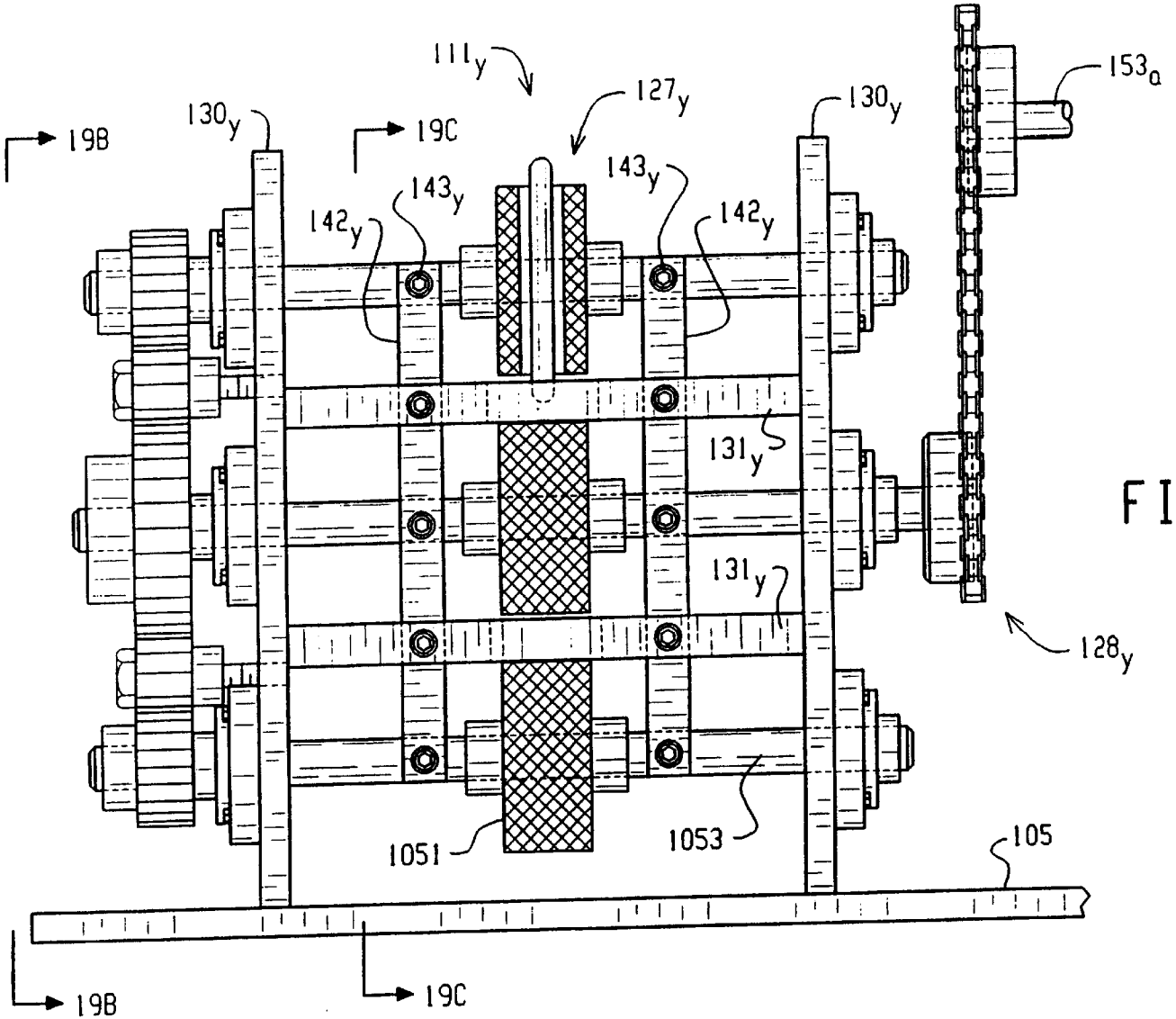
FIG. 19A is a plan view of a modified version of the feeding/connecting assembly of FIGS. 1 and 2.
Figure 19B:
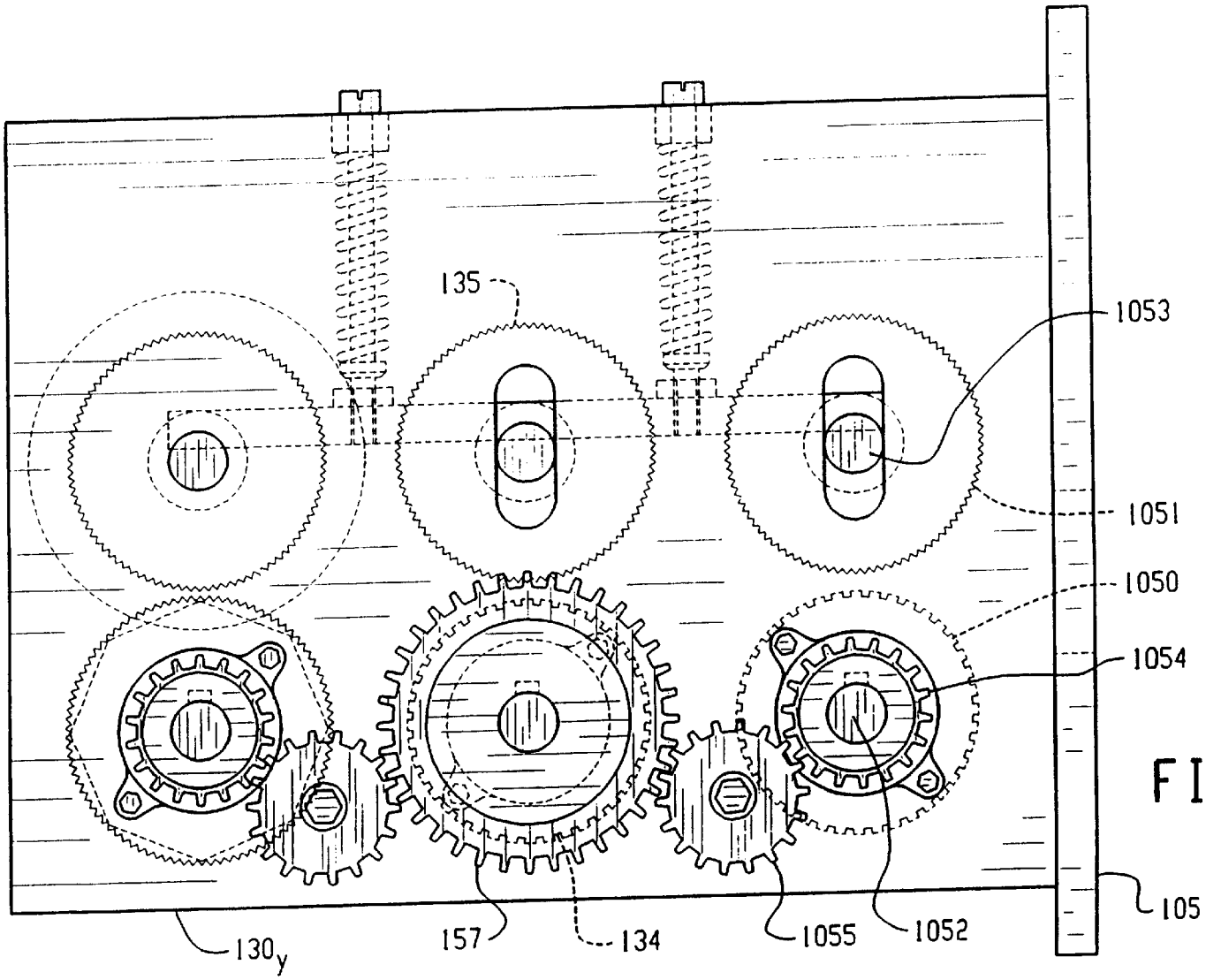
FIG. 19B is a side elevation view of the feeding/connecting assembly of FIG. 19A.
Figure 19C:
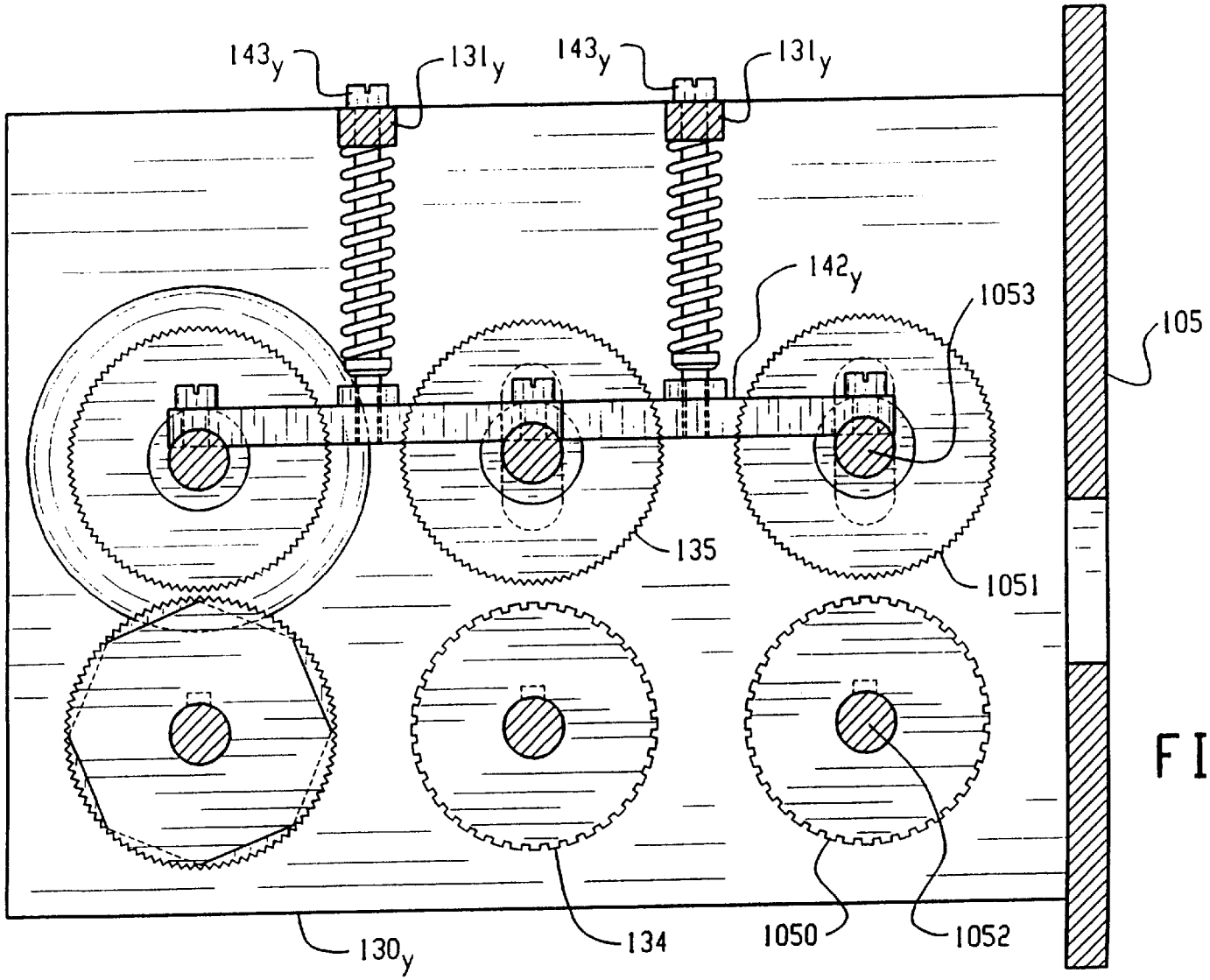
FIG. 19C is a cross-sectional view of the feeding/connecting assembly of FIG. 19A, the section being taken along line 19C—19C in FIG. 19A.

Another modified form 111$_y$ of the feeding/connecting assembly is shown in FIGS. 19A–19C. The wheel network 127$_y$ of this assembly includes a "stretching assembly" comprised of a stretch wheel 1050, its support wheel 1051, and corresponding shafts 1052 and 1053. During operation of the feeding/connecting assembly 111$_y$, the wheels 1050 and 1051 are rotated at a faster feed rate speed than the wheels 134 and 135 whereby the strip will be "stretched" prior to passing through the outlet opening in the end wall 105. The wheels 1050 and 1051 may be essentially identical in design and size as the wheels 134 and 135, respectively.

The addition of the wheels 1050 and 1051 necessitates changes in the support structure 126$_y$, the wheel network 127$_y$, and the drive system 128$_y$. The support structure 126$_y$ includes extended side walls 130$_y$ each with an additional slot to accommodate the shaft 1053, and a cross bars 131$_y$ positioned between each adjacent set of support wheels. In the wheel network 127$_y$, shaft-connectors 142$_y$ connect all three shafts 138, 140, and 1053, and two sets of suspension pins 143$_y$ couple the shaft-connectors 142$_y$ to the cross bars 132$_y$. In the drive system 128$_y$, gears 1054 and 1055 are added to the gear train, gear 1054 being mounted to the stretch wheel shaft 1052 and gear 1055 being mounted to the side wall 130$_y$ to convey motion from the gear 157 to the gear 1054. The gears 1054 and 1055 may be sized so that the stretch wheel 1050 is rotated anywhere between a feed rate speed just slightly faster than the compression wheel 134 to a feed rate speed equal to the feed wheel 132. Also, although not shown in FIGS. 19A–19C, the guide chute 129 (FIGS. 5A–5C) is preferably elongated and its slots modified to accommodate the wheels 1050 and 1051.

Figure 22:
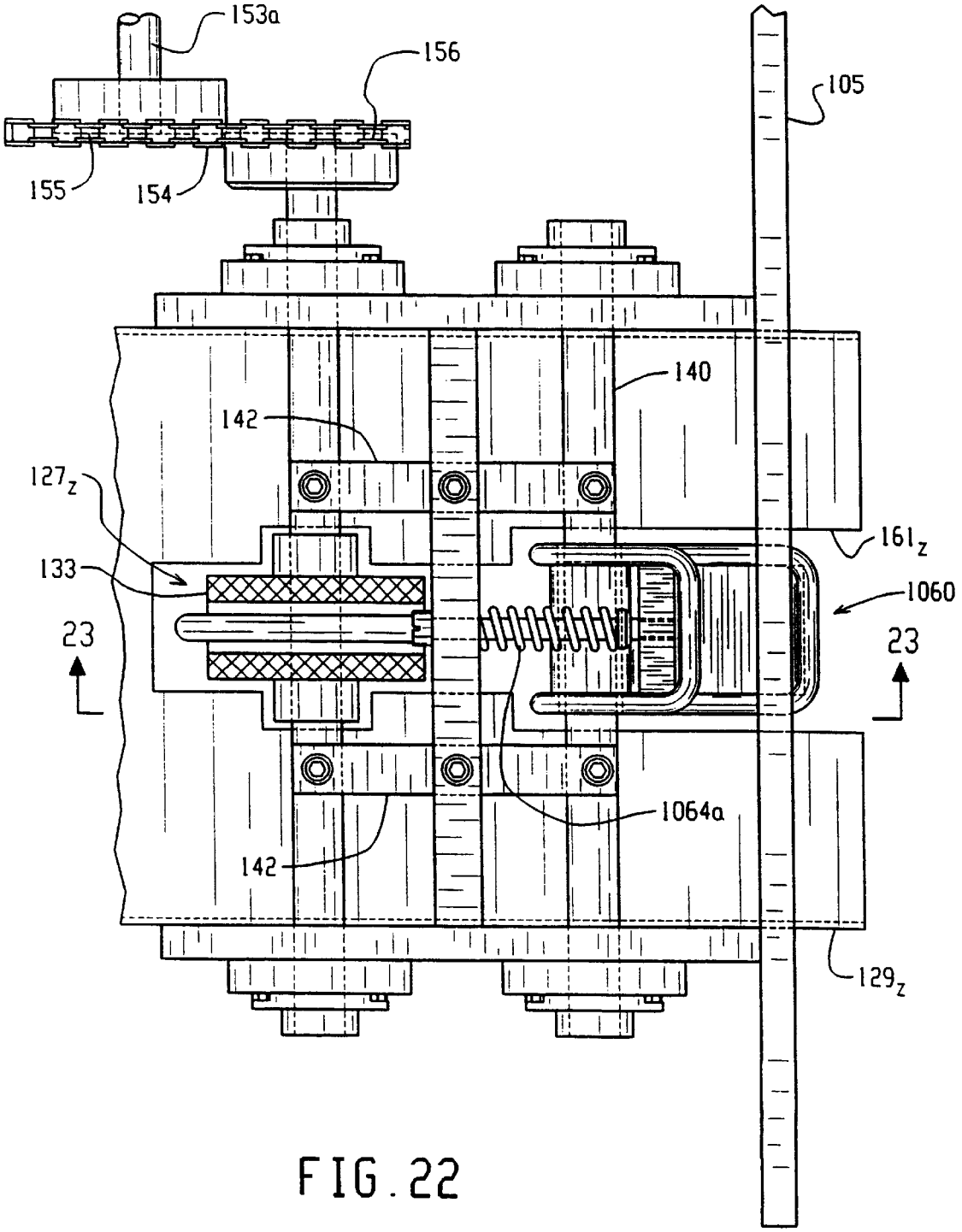
FIG. 22 is a plan elevation view of a modified version of the feeding/connecting assembly of FIGS. 1 and 2.
Figure 23:
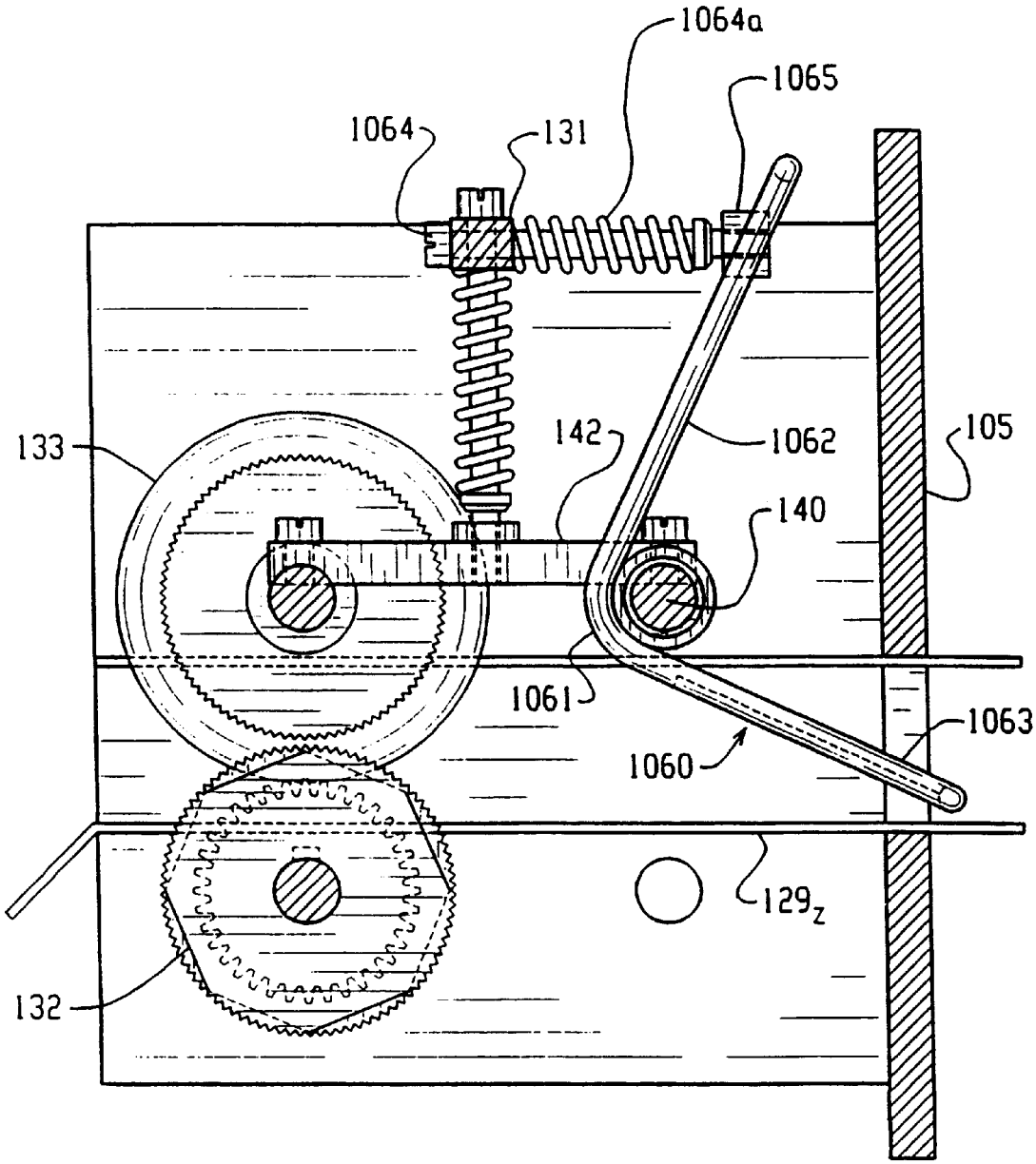
FIG. 23 is a cross sectional view of the feeding/connecting assembly of FIG. 22, the section being taken along fine 23—23 in FIG. 22.
Figure 24:
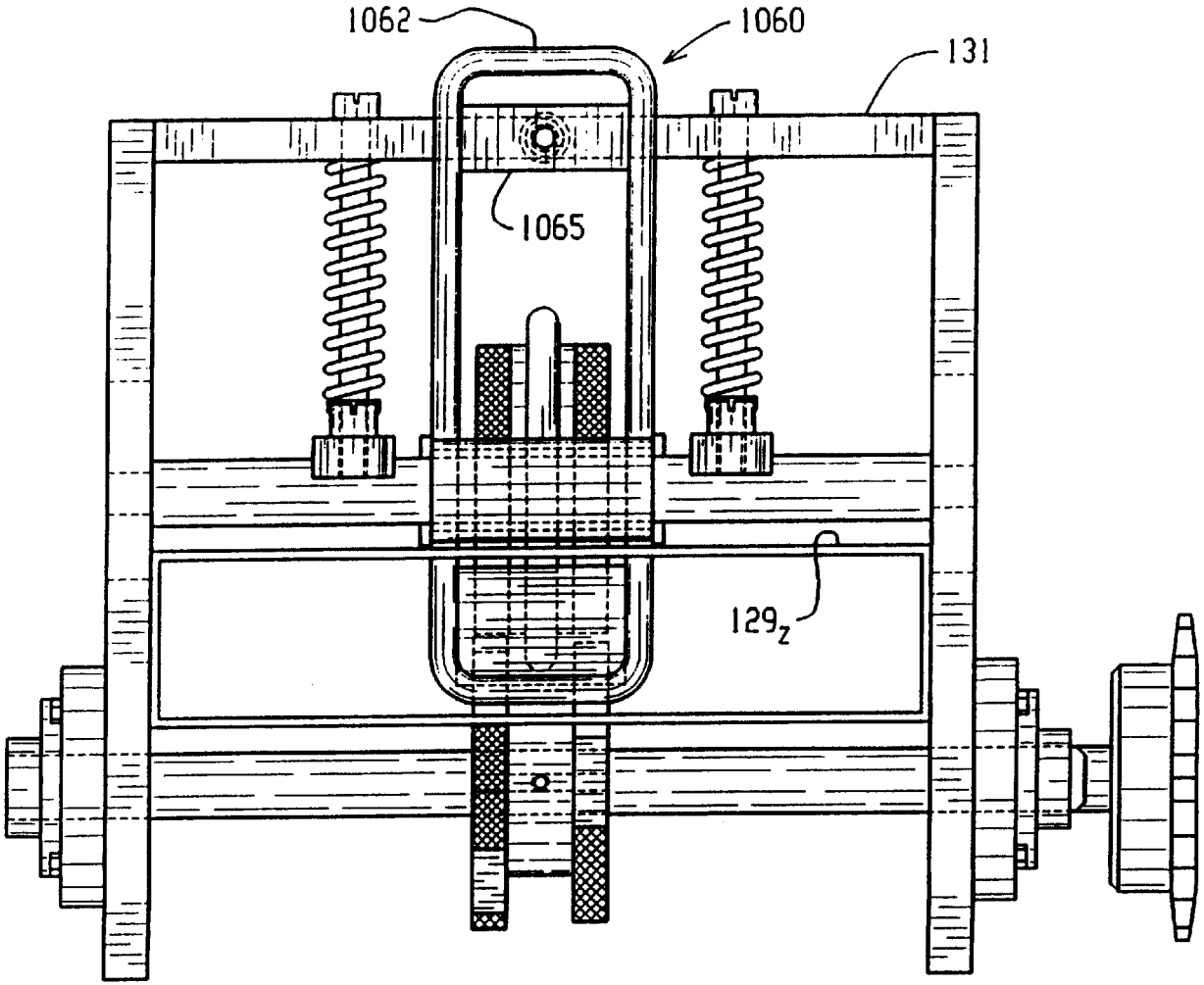
FIG. 24 is an end view of the feeding/connecting assembly of FIG. 22.

In a further modified form 111$_z$ of the feeding/connecting assembly shown in FIGS. 22–24, a movable barrier 1060 replaces the compression wheel 134, its support wheel 135, and the compression wheel shaft 139. The barrier 1060 is spring biased towards the feed wheel 132 so that as the strip of cushioning is expelled therefrom, it will be restricted by the barrier 1060, thereby crumpling the strip in a longitudinal direction. As pressure applied by the crumpling strip increases, the spring bias of the barrier 1060 will be overcome, and it will open to allow the crumpled strip to pass through the outlet opening in the end wall 105.

The illustrated barrier 1060 is made from a circular (in cross-section) bar formed into a rectangular loop having rounded corners. The loop is perpendicularly bent at a central portion to form a rounded corner 1061 between an upper portion 1062 and a lower portion 1063 of the barrier 1060. The corner 1061 of the barrier 1060 is rotatably attached around the shaft 140 (previously used for the support wheel 135). When in a rest position, the barrier's lower portion 1063 extends into the guide chute 129$_z$ in a downward and downstream sloping direction with its upper portion 1062 extending upwardly therefrom. In the wheel network 127$_z$, a guide pin 1064 is connected to, and extends horizontally from, cross bar 131. The pin 1064 is attached at its other end to a bracket 1065 secured to the top portion 1062 of the barrier, and a spring 1064*a* is carried on the pin 1064 and interposed between the bracket 1065 and the cross bar 131. As the pressure of the crumpling strip increases behind the lower portion 1063 of the barrier, the upper portion of the barrier 1062 will be pushed towards the cross-bar 131 thereby pivoting the lower portion 1063 upward to allow release of the strip. In the guide chute $\mathbf{129}_z$, the upper slot $\mathbf{161}_z$ is extended to the downstream edge of the guide chute, which extends beyond the outlet opening in the end wall 105. (See FIG. 22.) The drive system $\mathbf{128}_z$ is essentially the same as the drive system 128, except that the gear train 157–159 is eliminated.

Figure 6A:
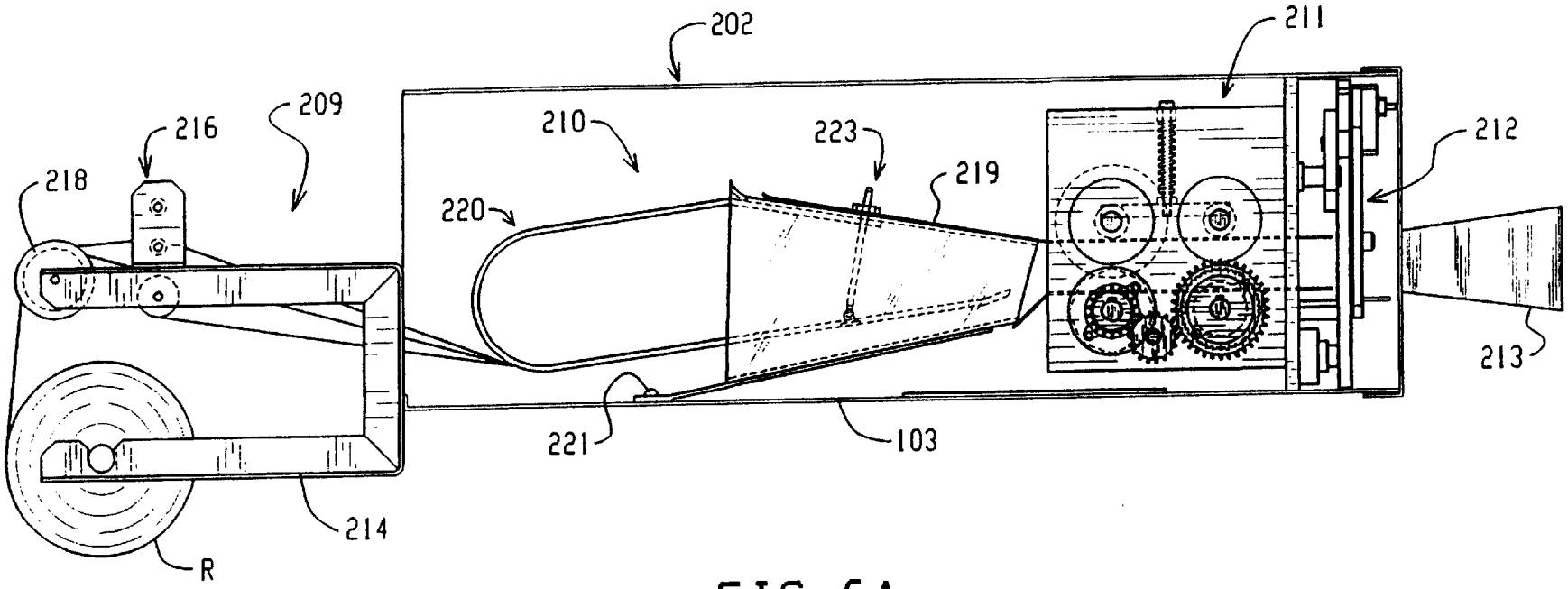
FIGS. 6A and 6B are schematic side and plan views, respectively, of another cushioning conversion machine 100 according to the present invention.
Figure 6B:
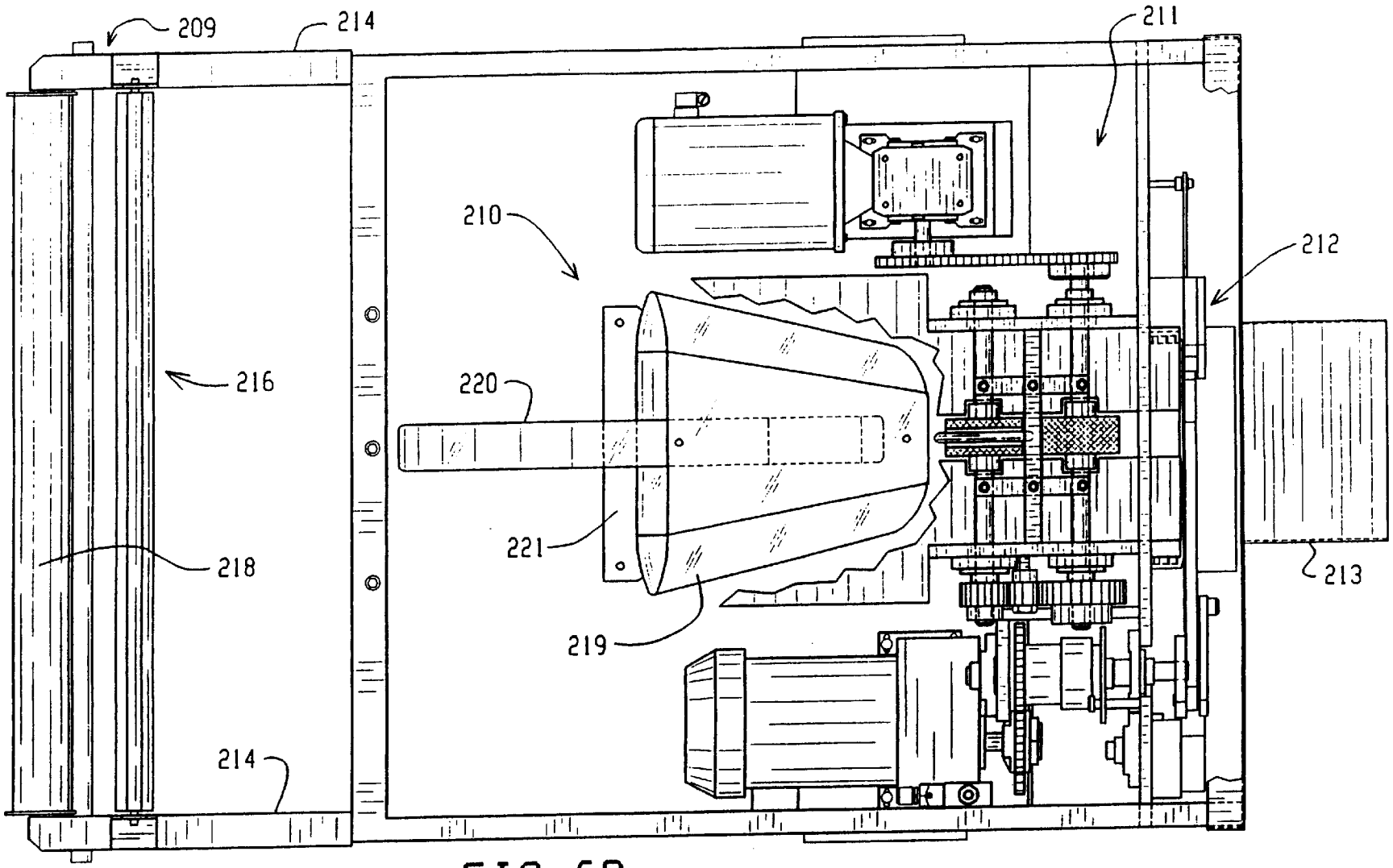

In FIGS. 6A and 6B, a cushioning conversion machine 200 is shown. The machine 200 converts sheet-like stock material into a three-dimensional cushioning product of a desired length. As with the machine 100, the preferred stock material for the machine 200 consists of plural plies or layers of biodegradable and recyclable sheet-like stock material such as 30 to 50 pound Kraft paper rolled onto a hollow cylindrical tube to form a roll R of the stock material. However, the stock material would preferably consist of three plies of paper and, in any event, would not be intermittently glued together. As with the machine 100, the preferred cushioning product of the machine 200 has lateral accordion-like or pillow-like portions and is connected, or assembled, along a relatively thin central band separating the pillow-like portions.

The machine 200 is similar to the machine 100 discussed above, and includes an essentially identical housing 202, feeding/connecting assembly 211, severing assembly 212, and post-severing assembly 213. However, the stock supply assembly 209 and the forming assembly 210 of the machine 200 differ from these assemblies in the machine 100.

The stock supply assembly 209 includes two support brackets 214 which are laterally spaced apart and mounted to the machine's frame, or more particularly the upstream wall (or rectangular border) 208. The stock supply assembly 209 also includes a sheet separator 216, and a constant-entry roller 218. The sheet separator 216 includes three vertically spaced rollers which extend between, and are connected to, the support brackets 214. (The number of separator rollers corresponds to the number of plies or layers of the stock material whereby more or less rollers could be used depending on the number of layers.) The constant-entry roller 218 also extends between, and is connected to, the support brackets 214.

As the paper is unwound from the supply roll R, it travels over the constant-entry roller 218 and into the separating device 216. In the separating device, the plies or layers of the stock material are separated by the separator rollers and this "pre-separation" is believed to improve the resiliency of the produced cushioning product. The constant-entry roller 218 provides a non-varying point of entry for the stock material into the separator 216 regardless of the diameter of the roll R. (Details of a similar stock supply assembly are set forth in U.S. Pat. No. 5,322,477, the entire disclosure of which is hereby incorporated by reference.)

The forming assembly 210 includes a shaping chute 219 and a forming member 220. The shaping chute 219 is longitudinally converging in the downstream direction and is positioned in a downstream portion of the enclosure formed by the machine's housing. Its entrance is outwardly flared in a trumpet-like fashion and its exit is positioned adjacent the feeding/connecting assembly 211. The chute 219 is mounted to the housing at the bottom wall 103 and at 221.

The forming member 220 has a "pinched U" or "bobby pin" shape including a bight portion joining upper and lower legs. The lower leg extends to a point approximately coterminous with the exit end of the shaping chute 219. The rearward portion of the forming member 220 preferably projects rearwardly of the entry end of the shaping chute by approximately one-half its overall length. Also, the radius of the rounded base or bight portion is approximately one-half the height of the mouth of the shaping chute. This provides for a smooth transition from the separating device 216 to the forming member and then into the shaping chute.

Figure 6C:
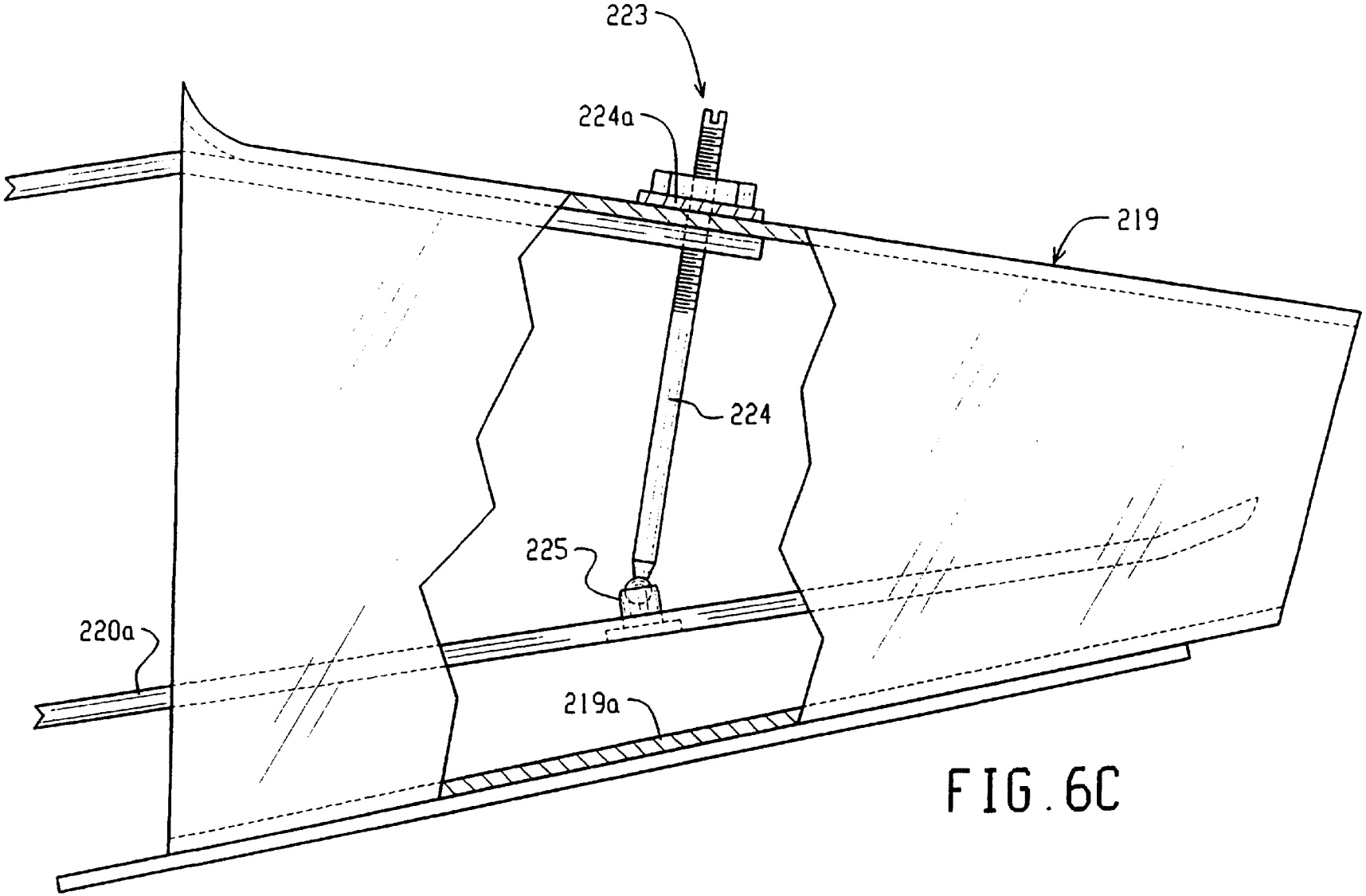
FIG. 6C is schematic side view of the forming assembly of the cushioning conversion machine.

The lower leg 220*a* of the forming member 220 extends generally parallel to the bottom wall 219*a* of the shaping chute 219. However, the relative inclination and spacing between the lower leg of the forming member and bottom wall of the shaping chute may be adjusted as needed to obtain proper shaping and forming of the lateral edges of the stock material. Such adjustment may be effected and then maintained by an adjustment device 223 which, as best shown in FIG. 6C, extends between the legs of the forming member at a point midway along the length of the lower leg, it being noted that the upper leg may be shorter as only sufficient length is needed to provide for attachment of the top wall of the shaping chute. The adjustment device 223 includes a rod 224 having a lower end attached to the lower leg of the forming member 220 by a rotation joint 225 (such as a ball-and-socket joint). The upper threaded end of the rod 224 extends through a threaded hole in the top wall of the shaping chute as well as through a threaded hole in a upper leg of the forming member 220 and is held in place by a nut 224*a* secured to the shaping chute 219. To adjust the gap between the lower leg of the forming member and the bottom wall of the shaping chute, the top of the threaded rod is turned the appropriate direction. The rod's top may be provided with a screwdriver slot or wrench flats, to easily accomplish this turning with standard tools.

Further details of the preferred chute 219 and shaping member 220 are set forth in U.S. application Ser. No. 08/487,182, the entire disclosure of which is hereby incorporated by reference. However, it should be noted that other chutes and shaping members are possible with, and contemplated by, the present invention. By way of example, the chutes and/or shaping members set forth in U.S. Pat. Nos. 4,026,198; 4,085,662; 4,109,040; 4,717,613; and 4,750,896, could be substituted for the forming chute 219 and/or the shaping member 220.

As the stock material passes through the shaping chute 219, its lateral end sections are rolled or folded inwardly into generally spiral form and are urged inwardly toward one another so that the inwardly rolled edges form a pillow-like portions of stock material disposed in lateral abutting relationship as they emerge from the exit end of the shaping chute. The forming member 220 coacts with the shaping chute 219 to ensure proper shaping and forming of the paper, the forming ember being operative to guide the central section of the stock material along the bottom wall of the chute 219 for controlled inward rolling of the lateral side sections of the stock material. The rolled stock material, or strip, then travels to the feeding/connecting assembly 211.

Another cushioning conversion machine 300, formed from modular units 300*a* and 300*b* according to the present invention, is shown in FIGS. 11A, 11B,11C and 12. The machine 300 converts sheet-like stock material into a three-dimensional cushioning product of a desired length. As with the machines 100 and 200, the preferred cushioning product of the machine 300 has lateral crumpled pillow-like portions and is connected, or assembled, along a central band separating the pillow-like portions. As with the machines 100 and 200, the preferred stock material for the machine 300 consists of plural plies or layers of biodegradable and recyclable sheet-like stock material such as 30 to 50 pound Kraft paper rolled onto a hollow cylindrical tube to form a roll R of the stock material.

The first modular unit 300*a* includes a housing 302*a* similar to the downstream portion of the housing 102 of the machine 100. (See FIG. 11A.) A feeding/connecting assembly 311, a severing assembly 312 and a post-severing assembly 313, which are essentially identical to the corresponding assemblies in the machine 100, are mounted to the housing 302*a* in the same manner as they are mounted the downstream portion of the housing 102. However, an expanding device 370 occupies the space in the machine housing 102 that had been occupied by the forming assembly 110 and requires less space. (See FIG. 11A.) Additionally, a guide roller 372 is mounted to the upstream end of the housing 302*a* via brackets 374.

The expanding device 370 includes a mounting member 378 to which a separating member 380 is joined. (See FIGS. 11B and 11C.) The mounting member 378 includes a transverse support or mounting arm 381 having an outwardly turned end portion 383 and an oppositely turned end portion 385 to which the separating member 380 is attached. The outer end portion 383 is mounted to the housing 302*a* by a bracket 387 and suitable fastening elements.

The separating member 380 includes a transverse support 393 and fold expansion elements 395 at opposite ends of the transverse support 393 that are relatively thicker than the transverse support 393, with respect to the narrow dimension of the stock material. In the illustrated expanding device, the mounting member 378 is formed by a rod or tube, and the fold expansion elements are formed by rollers supported for rotation on the transverse support at opposite ends thereof. The transverse support 393 is attached near one end thereof to the adjacent end portion 385 of mounting member 381 for support in cantilevered fashion.

The expanding device 373 is designed for use with flat-folded stock material which is formed by the second modular unit 300*b*. During the conversion process, the layers of the stock material (formed by the edge and central portions of the ply or plies) travel through the expanding device 373. More particularly, the central section of the folded stock material travels over the sides of the rollers 395 opposite the mounting arm 381, while the inner edge portion of the stock material travels in the narrow V-shape or U-shape slot formed between the transverse support 393 and the mounting arm 381 and the other or outer edge portion of the travels over the side of the mounting arm 381 furthest the separating member 380. As a result, the lateral end sections are separated from one another and from the central section, thereby introducing loft into the then expanded material which now takes on a three dimensional shape as it enters the guide chute of the feeding/connecting device 311. Further details of the expanding device 370 are set forth in U.S. patent application Ser. No. 08/584,092, which is hereby incorporated herein by reference in its entirety.

The second modular unit 300*b* includes a housing 302*b* similar to the upstream portion of the housing 102 of the machine 100. (See FIG. 12.) A forming assembly 310 is essentially identical to, and is mounted to the housing 302*b* in the same manner as, the corresponding assembly in the machine 100. However, a stock roll R may be supported by a floor mounted stand or stock roll support 2002. Additionally, a guide roller 398 is mounted to a downstream end of the housing 302*a* via bracket 399.

Figure 13:
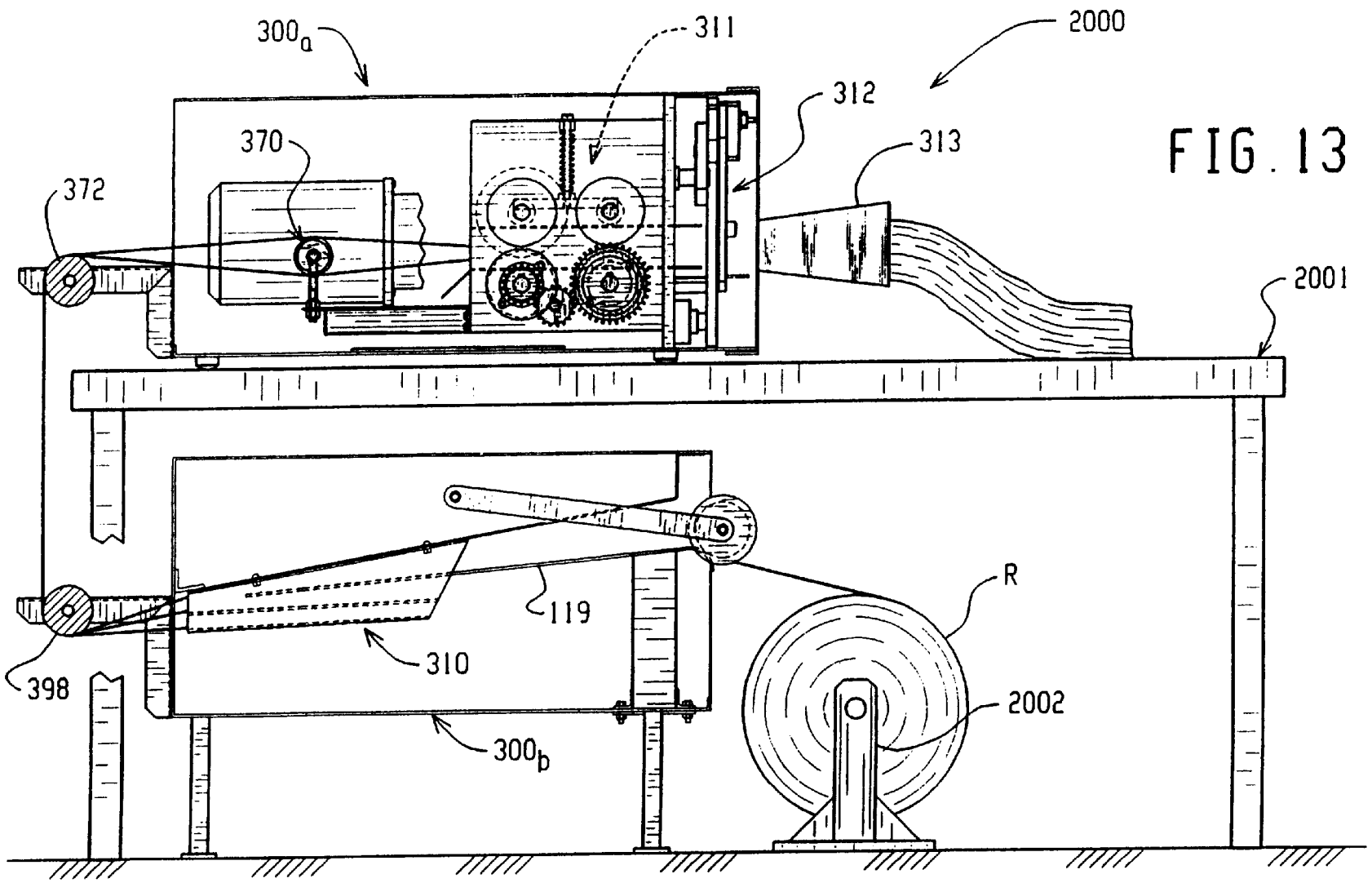
FIGS. 13–15 are side elevation view of three packaging systems according to the present invention which incorporates the cushioning conversion machine shown in FIGS. 11A and 12.

A packaging system 2000 incorporating the cushioning conversion machine 300 is shown in FIG. 13. In addition to the machine 300, the system includes a table 2001 and a floor-mounted stock support 2002. The first modular unit 300*a* is located on top of the table 2001 and the second modular unit 300*b* is located below the table. As the stock material is unwound from the roll R, it travels from the support 2002, over the plate 119 through the forming assembly 310, under the guide roller 398 (positioned between the legs of the table), over the guide roller 372, through the expanding device 370 and into the feeding/connecting assembly 311. The strip is then severed by the severing assembly 312 and the cut section travels through the post-severing assembly 313.

Figure 14:
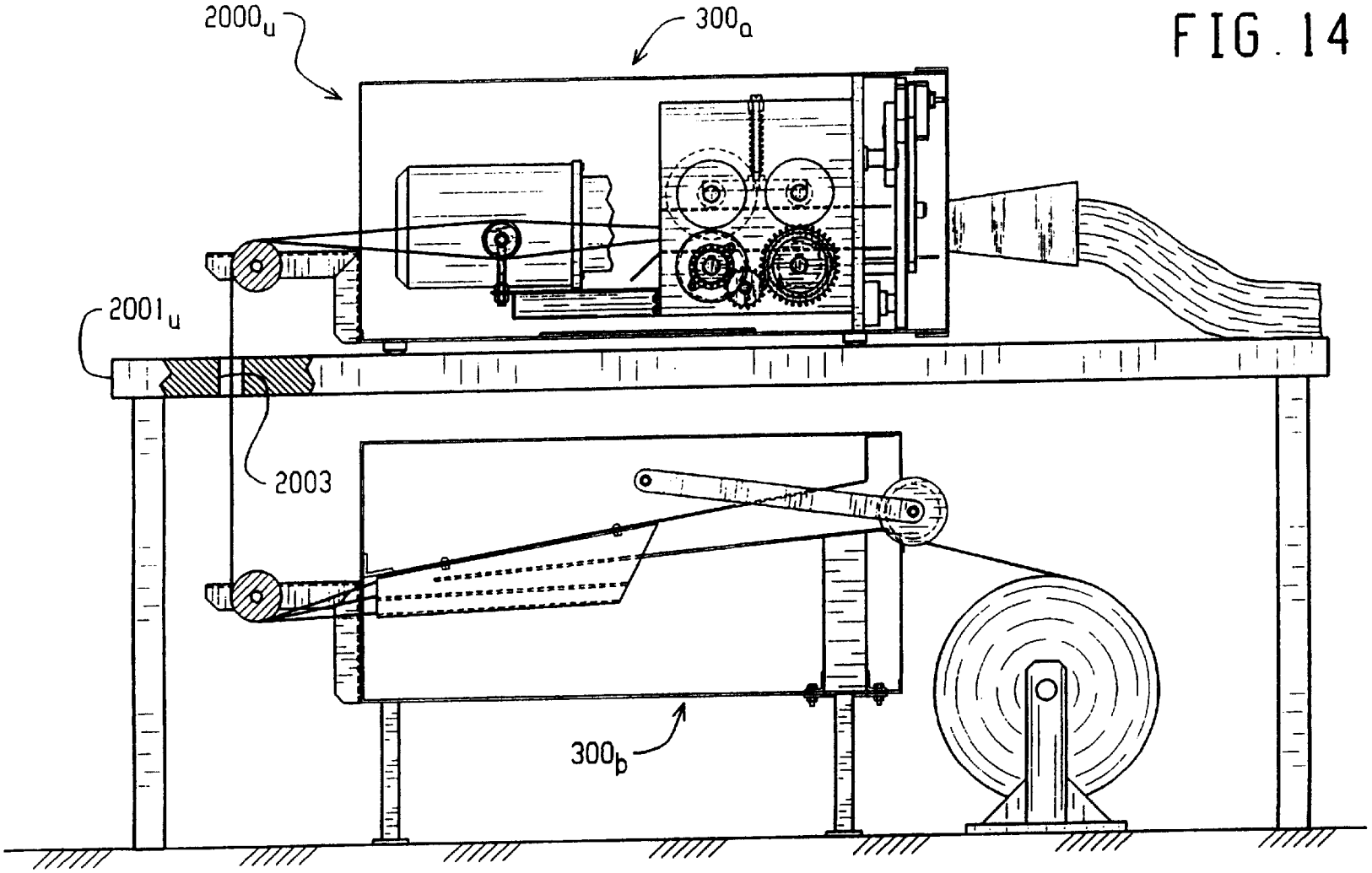

A modified version $\mathbf{2000}_u$ of the packaging system is shown in FIG. 14. In the packaging system $\mathbf{2000}_u$, the folded stock material from the unit 300*b* passes through an opening 2003 in the table $\mathbf{2001}_u$. This arrangement allows a more central positioning of the units 300*a* and 300*b* relative to the table $\mathbf{2001}_u$ and also protects the folded strip from interference as it travels between the units.

Figure 15:
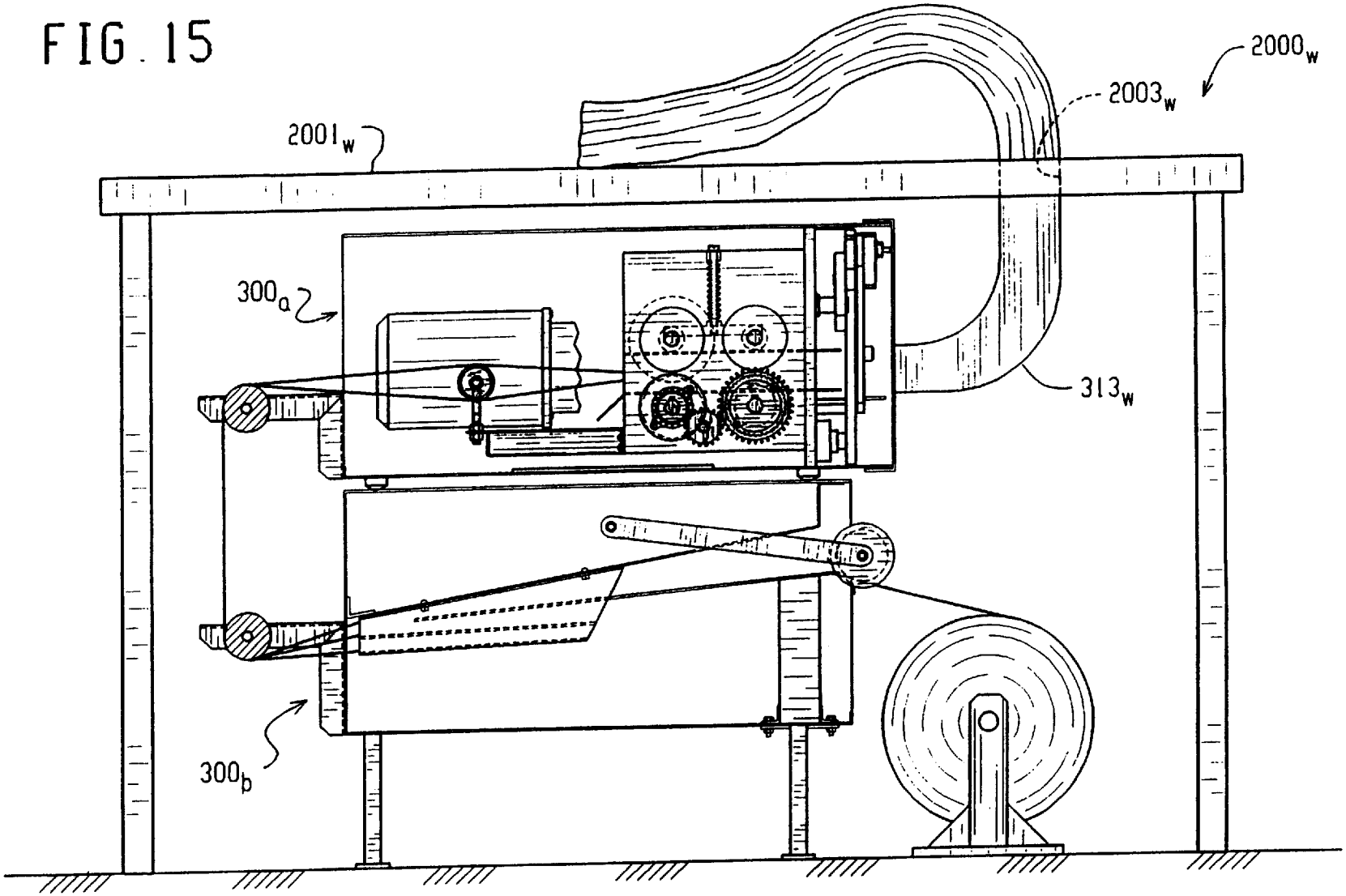

Another modified version $\mathbf{2000}_w$ of the packaging system is shown in FIG. 15. In the packaging system $\mathbf{2000}_w$, the first unit 300*a* is stacked on top of the second unit 300*b* below an elevated (when compared to tables 2001 and $\mathbf{2001}_w$) table $\mathbf{2001}_w$. Additionally, the post-severing assembly $\mathbf{313}_w$ is curved upwardly towards an opening $\mathbf{2003}_w$ in the table whereby the cut section of cushioning will be deposited on the table top. This arrangement allows the table top to be clear of all machine components during the production of cushioning products.

Figure 16:
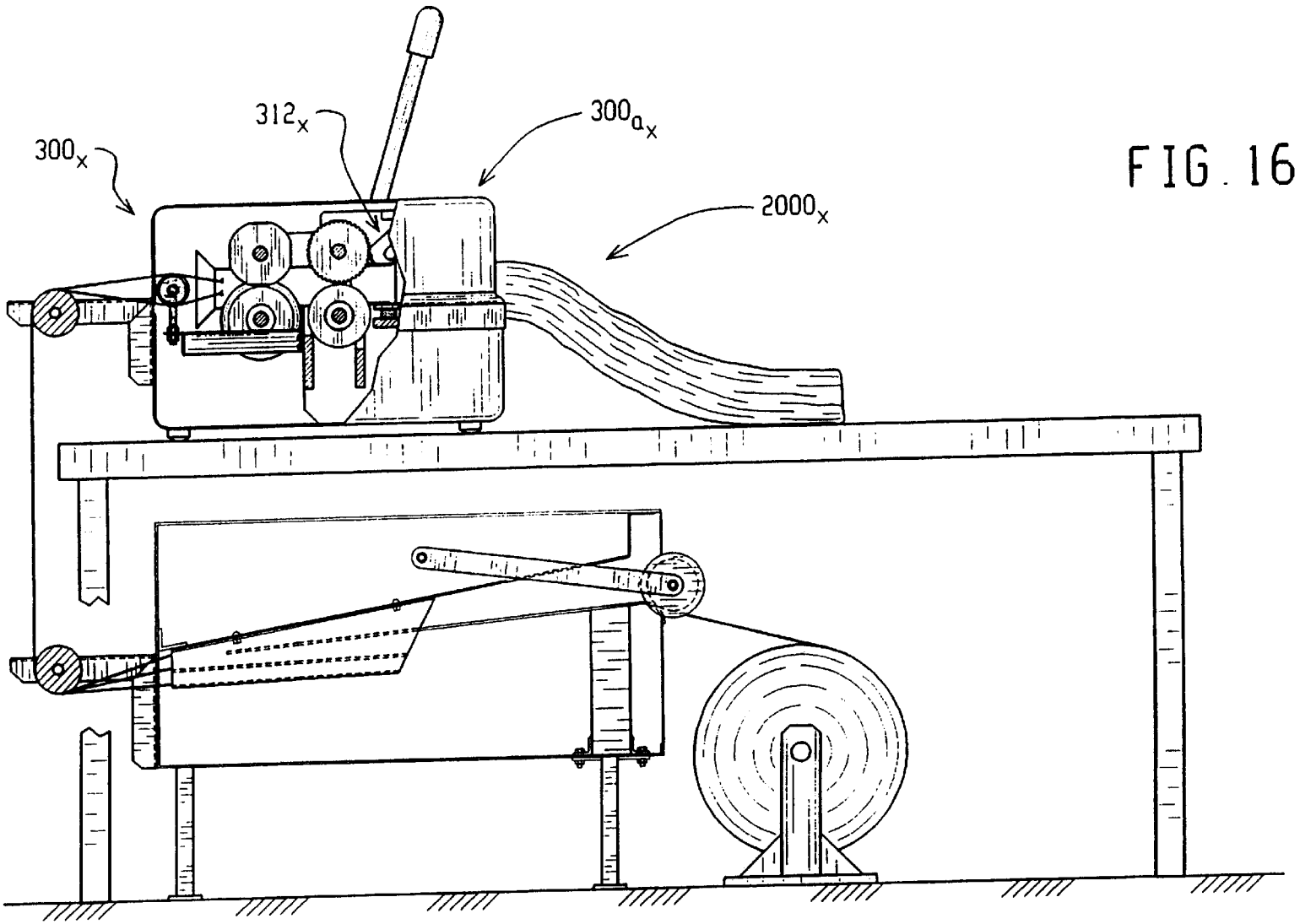
FIG. 16 is a side elevation view of a packaging system according to the present invention which incorporates a modified version of the second modular unit shown in FIG. 12.

Another packaging system $\mathbf{2000}_x$ according to the present invention is shown in FIG. 16. This packaging system incorporates a machine $\mathbf{300}_x$ which is similar to the machine 300 except for its first modular unit $\mathbf{300}a_x$. Specifically, the unit $\mathbf{300}a_x$ has manual, rather than motor-powered, severing assembly $\mathbf{312}_x$. Additionally, the housing $\mathbf{300}b_x$ is in the form of a two part casing. The other components, such as the expanding device 370 and the feeding/connecting assembly 311, operate in essentially the same manner as described above. For further details of the unit $\mathbf{300}b_x$, reference may be had to U.S. patent application Ser. No. 08/584,092.

One may now appreciate that the present invention provides an improved cushioning conversion machine related methodology. Although the invention has been shown and described with respect to certain preferred embodiments, it is obvious that equivalent alterations and modifications will occur to others skilled in the art upon the reading and understanding of this specification. The present invention includes all such equivalent alterations and modifications. Accordingly, while a particular feature of the invention may have been described above with respect to only one of the illustrated embodiments, such feature may be combined with one or more features of the other embodiments, as may be desired and advantageous for any given or particular application.

It is noted that the position references in the specification (i.e, top, bottom, lower, upper, etc.) are used only for ease in explanation when describing the illustrated embodiments and are in no way intended to limit the present invention to particular orientation. Also, the terms (including a reference to a "means") used to identify the herein-described assemblies and devices are intended to correspond, unless otherwise indicated, to any assembly/device which performs the specified function of such an assembly/device that is functionally equivalent even though not structurally equivalent to the disclosed structure which performs the function in the illustrated exemplary embodiment of the invention.

What is claimed is:

1. A cushioning conversion machine for making a cushioning product by converting an essentially two-dimensional web of sheet-like stock material of at least one ply into a three-dimensional cushioning product, comprising:

a housing through which the stock material passes along a path; and a feeding/connecting assembly which advances the stock material from a source thereof along said path, crumples the stock material, and connects the crumpled stock material to produce a strip of cushioning, said feeding/connecting assembly including:

upstream and downstream components disposed along said path of the stock material through said housing, at least the upstream component being driven to advance the stock material toward the downstream component at a rate faster than the sheet-like stock material can pass from the downstream component to effect crumpling of the stock material therebetween to form a strip of cushioning, and a stretching component downstream of said downstream component operative to advance the strip of cushioning at a rate faster than the rate at which the stock material passes from the downstream component to effect longitudinal stretching of the strip of cushioning.

2. A conversion machine as set forth in claim 1, wherein said feeding/connecting assembly includes an adjustable speed control mechanism for varying the speed at which the stretching component advances the material, whereby a characteristic of the strip of cushioning can be varied.

3. A conversion machine as set forth in claim 1, wherein the downstream feed component is driven to advance the material at a rate less than the rate at which material is advanced by the upstream component.

4. A conversion machine as set forth in claim 2, wherein said feeding/connecting assembly includes an adjustable speed control mechanism for varying the ratio of the rates at which the upstream and downstream components advance the stock material.

5. A cushioning conversion machine as set forth in claim 1, wherein at least one of said opposed members is at least partially made of an elastomeric material at a surface thereof engageable with the stock material.

6. A conversion machine as set forth in claim 5, wherein the elastomeric material is rubber.

7. A cushioning conversion machine as set forth in claim 1, said feeding/connecting assembly including:

at least one rotatable member rotatable in a first direction for engaging and advancing the stock material along said path, a feed motor for driving said one rotatable member in said first direction, and a crank coupled to said rotatable member for enabling rotation of said one rotatable member in a second direction opposite said first direction.

8. A conversion machine as set forth in claim 7, wherein said crank is connected to said rotatable member through a one-way clutch which permits rotation of said one rotatable member in said first direction by said feed motor while the crank can remain stationary, and said crank to rotate said one rotatable member in said second direction when said one rotatable member is not being driven by said feed motor.

9. A cushioning conversion machine as set forth in claim 1, wherein the downstream feeding component is driven intermittently to advance periodically the stock material, whereby when the downstream feeding component is not being driven the stock material will be caused to crumple longitudinally between the upstream and downstream feeding components, and when driven the longitudinally crumpled stock material will be advanced by the downstream feeding component toward an exit end of the machine.

10. A conversion machine as set forth in claim 9, wherein said upstream and downstream components each include a rotating member for drivingly engaging the stock material, and said feeding/connecting assembly includes a motor coupled to said rotating member of said upstream component for continuously driving said upstream component during a cushioning formation operation, and to said rotating member of said downstream component by an indexing gear mechanism that effects intermittent rotation of said rotating member of said downstream component.

11. A conversion machine as set forth in claim 10, wherein the indexing gear mechanism includes a Geneva gear mechanism.

12. A conversion machine as set forth in claim 9, wherein said feeding/connecting assembly includes opposed guides extending between said upstream and downstream components for containing the crumpled strip therebetween.

13. A cushioning conversion machine as set forth in claim 1, the feeding/connecting assembly further including a manual reversing mechanism coupled to the rotatable member to reverse its direction of rotation for clearing paper jams in the feeding/connecting assembly.

14. A cushioning conversion machine as set forth in claim 1, including a modular arrangement of said forming assembly and said feeding/connecting assembly in separate units that may be positioned remotely from one another.

15. A cushioning conversion machine as set forth in claim 13, further including a control mechanism which enable an operator to selectively adjust the conversation assembly to vary cross-sectional characteristic of the cushioning product, wherein the control mechanism which includes an accessible control member outside said housing for enabling easy operator adjustment of said cross-sectional characteristic of the cushioning product.

16. A cushioning conversion machine as set forth claim 15, wherein the feeding/connecting assembly includes opposed members between which the stock material is passed and pinched by said opposed members with a pinch pressure; and wherein the control mechanism is a tension control mechanism for adjusting the amount of pinch pressure applied by said opposed members to the stock material.

17. A cushioning conversion machine as set forth claim 15 further comprising a forming device which folds lateral edges of the sheet-like stock material inward to form a strip and the feeding/connecting assembly advances the stock material through the forming device.

18. A cushioning conversion machine as set forth in claim 16 wherein the control mechanism is operably coupled to the feeding/connecting assembly.

19. A cushioning conversion machine as set forth in claim 16 wherein the tension control mechanism adjusts the amount of pinch pressure applied to the stock material by said opposed members of said downstream component independently of the pinch pressure applied to the stock material by said opposed members of said upstream component.

20. A conversion machine as set forth in claim 19, wherein the control mechanism includes an adjustable speed control mechanism for varying the ratio of the feeding speeds of the upstream and downstream components whereby a characteristic of the strip of cushioning can be varied.

21. A cushioning conversion machine for making a cushioning product by converting an essentially two-dimensional web of sheet-like stock material of at least one ply into a three-dimensional cushioning product, comprising first and second units having separate housings whereby the first and second units can be located at spaced apart locations, said first unit including in the housing thereof a former for folding the sheet-like stock material to form flat folded stock material having a plurality of layers each joined at a longitudinally extending fold to at least one other layer, and said second unit including in the housing thereof an expanding device operative, as the flat folded stock material passes therethrough, to separate adjacent layers of the flat folded stock material from one another to form an expanded strip of stock material, and a feeding/connecting assembly which advances the stock material through the expanding device, crumples the expanded stock material passing from the expanding device, and connects the crumpled strip to produce a strip of cushioning.

22. A conversion machine as set forth in claim 21, wherein one of said first and second units is supported atop the other.

23. A conversion machine as set forth in claim 22, in combination with a table including a table top having a packaging surface, and said first and second units are both located beneath said packaging surface.

24. A conversion machine as set forth in claim 21, in combination with a table including a table top having a packaging surface, and said first and second units are both located beneath said table top.

25. A conversion machine as set forth in claim 21, in combination with a table including a table top having a packaging surface, and said first unit is located beneath said table top and said second unit is supported on said table top.

26. A conversion machine as set forth in claim 25, wherein said table top has an opening therein for passage of the flat folded stock material from said first unit to said second unit.

27. A cushioning conversion machine for making a cushioning product by converting an essentially two-dimensional web of sheet-like stock material of at least one ply into a three-dimensional cushioning product, comprising:

a supply assembly for supplying the sheet-like stock material; and a conversion assembly which converts the sheet-like stock material received from the supply assembly into a three-dimensional strip of cushioning:

said stock supply assembly including a support for a supply of the stock material from which the stock material can be dispensed, and a layering device which effects folding of the stock material along a fold line parallel to the longitudinal axis of the stock material, thereby in effect doubling the number of layers of the stock material that are converted into the cushioning product, the stock supply assembly, including the layering assembly, being located in an upstream direction from the conversion assembly.

28. A conversion machine as set forth in claim 27, wherein said layering device has a triangular shape having an entry edge and converging side edges over which respective edge portions of the stock material pass and fold inwardly towards one another.

29. A conversion machine as set forth in claim 28, wherein the stock supply assembly includes a spindle for supporting a roll of stock material, and said entry edge of said layering device is parallel to said spindle.

30. A conversion machine as set forth in claim 29, wherein said layering device includes a triangular plate.

31. A conversion machine as set forth in claim 29, wherein said entry edge is curved through an angle greater than 90°.

32. A cushioning conversion machine as set forth in claim 27, wherein the conversion assembly includes:

a forming assembly through which the sheet-like stock material is advanced to form the stock material into a three-dimensional shape, said forming assembly including a forming member and a converging chute cooperative with said forming member to cause inward rolling of the edges of the stock material to form lateral pillow-like portions of a formed strip, the forming member being positioned at least partially within the converging chute; and a feeding/connecting assembly which advances and crumples the formed strip, and connects the crumpled formed strip to produce a strip of cushioning, said feeding/connecting assembly including upstream and downstream components disposed along the path of the stock material through said machine, at least the upstream component being driven to advance the stock material toward the downstream component at a rate faster than the sheet-like stock material can pass from the downstream component to effect crumpling of the stock material therebetween to form a strip of cushioning;

wherein said forming member has a U-shape with a first leg attached to a top wall of said chute and a second leg extending into said chute generally parallel with a bottom wall of said chute, each of said first leg and said second leg generally extending in a common direction.

33. A cushioning conversion machine as set forth in claim 1, further including a layering device which provides for doubling of the layers of sheet material in the three-dimensional cushioning product, the layering device located upstream of said upstream and downstream components.

34. A cushioning conversion machine as set forth in claim 1, wherein said source comprises a stock supply roll and further including a turner bar which enables alternative positioning of the stock supply roll upstream of said feeding/connecting assembly.

35. A cushioning conversion machine as set forth in claim 1, further comprising a forming assembly for folding sheet-like stock material to form flat folded stock material having a plurality of layers each joined at a longitudinally extending fold to at least one other layer and including a volume expanding arrangement interposed between the forming assembly and the feeding/connecting assembly to be cooperative with the feeding/connecting assembly for reducing the density of the cushioning product and increasing product yield.

36. A conversion machine as set forth in claim 20, wherein said adjustable speed control mechanism is a member selected from a group consisting of:

a quick change gear set;

a variable speed control for at least one of respective motors which drive said upstream and downstream components; and a variable pitch pulley system.

37. A conversion machine comprising a conversion assembly which converts an essentially two-dimensional web of sheet-like stock material of at least one ply into a three-dimensional cushioning product and a control mechanism which enables an operator to selectively adjust the conversion assembly to vary a cross-sectional characteristic of the cushioning product, wherein the control mechanism includes an accessible control member outside said housing for enabling easy operator adjustment of said cross-sectional characteristic of the cushioning product and further comprises a stretching component downstream of the feeding device which advances the stock material faster than a downstream component of the feeding device to effect longitudinal stretching of the strip of cushioning, and a control mechanism comprises an adjustable speed control mechanism for varying the speed at which the stretching component advances the stock material.

* * * * *

UNITED STATES PATENT AND TRADEMARK OFFICE

CERTIFICATE OF CORRECTION

PATENT NO. : 6,019,715

DATED : February 1, 2000

INVENTOR(S) : Richard O. Ratzel; Michael J. Lencoski; Donald J. Barnhouse; Joseph J. Harding; James A. Simmons It is certified that error appears in the above-identified patent and that said Letters Patent is hereby corrected as shown below:

In claim 5, line 1, after "at least one of said", please insert -- upstream and downstream components include-- and after "opposed members", insert --which--.

Signed and Sealed this

Second Day of January, 2001

*Attest:*

*Attesting Officer*

Q. TODD DICKINSON

*Commissioner of Patents and Trademarks*